US008079593B2

(12) United States Patent
Nicely et al.

(10) Patent No.: US 8,079,593 B2
(45) Date of Patent: Dec. 20, 2011

(54) SELF-CONTAINED DICE SHAKER SYSTEM

(75) Inventors: Mark C. Nicely, Daly City, CA (US); William R. Wells, Reno, NV (US)

(73) Assignee: IGT, Reno, NV (US)

( * ) Notice: Subject to any disclaimer, the term of this patent is extended or adjusted under 35 U.S.C. 154(b) by 7 days.

(21) Appl. No.: 12/509,837

(22) Filed: Jul. 27, 2009

(65) Prior Publication Data

US 2011/0018194 A1 Jan. 27, 2011

(51) Int. Cl.
*A63F 9/04* (2006.01)

(52) U.S. Cl. ..... 273/145 CA

(58) Field of Classification Search ..... 273/145 CA
See application file for complete search history.

(56) References Cited

U.S. PATENT DOCUMENTS 2,109,736 A * 3/1938 Roth ..... 273/246
2,302,333 A * 11/1942 Linke ..... 273/145 CA
2,619,349 A * 11/1952 Abrahamson ..... 273/238
2,693,962 A * 11/1954 Stevens ..... 273/145 D
3,508,755 A * 4/1970 Johnson ..... 273/145 R
3,820,792 A * 6/1974 Woodall, Jr. ..... 273/145 C
4,095,796 A * 6/1978 Monson ..... 273/145 C
4,195,841 A * 4/1980 Woodall, Jr. ..... 273/145 C
4,469,329 A * 9/1984 Guyer ..... 273/146
4,546,978 A * 10/1985 David ..... 273/146
4,632,397 A * 12/1986 Rivkin ..... 273/145 CA
4,826,170 A 5/1989 Rattai
5,100,141 A * 3/1992 Fitch ..... 273/145 B
5,139,266 A * 8/1992 Mullins et al. ..... 273/240
5,145,119 A * 9/1992 Lowe ..... 241/101.2
5,259,618 A 11/1993 Ramos
5,662,330 A * 9/1997 Spears ..... 273/274
5,741,087 A * 4/1998 Osadchuk ..... 405/179
5,839,960 A * 11/1998 Parra et al. ..... 463/41
5,885,157 A * 3/1999 Harada et al. ..... 463/22
5,946,303 A * 8/1999 Watson et al. ..... 370/254
6,415,207 B1 * 7/2002 Jones ..... 701/1
6,424,931 B1 * 7/2002 Sigmar et al. ..... 702/188
6,529,589 B1 * 3/2003 Nelson et al. ..... 379/102.01
6,546,004 B2 * 4/2003 Gullicksen ..... 370/352
6,575,834 B1 * 6/2003 Lindo ..... 463/40
6,676,522 B2 * 1/2004 Rowe et al. ..... 463/42

(Continued)

OTHER PUBLICATIONS

"Automatic Dice Tumbler," sales advertisement from Casinosupply.com; retrieved from the Internet at http://www.casinosupply.com/Automatic-Dice-Tumbler_p_2458.html on Jun. 21, 2010, 1 page.

(Continued)

*Primary Examiner* — Gene Kim
*Assistant Examiner* — Dolores Collins
(74) *Attorney, Agent, or Firm* — Weaver Austin Villeneuve & Sampson LLP

(57) ABSTRACT

The disclosure relates generally to different devices, methods, systems, and computer program products for a self-contained dice shaker assembly. The self-contained dice shaker assembly may include a container device defining an opening into an interior configured for receipt of one or more dice and a sensor assembly in communication with the container interior. The sensor assembly may be configured to monitor, in accordance with one or more predetermined parameters, the shake quality of the dice in the container during a shaking event. The self-contained dice shaker assembly may include an identification assembly operable to identify the outcome of a respective outcome face of each die associated with the outcome of a shaking event.

20 Claims, 11 Drawing Sheets

U.S. PATENT DOCUMENTS

| | | | | |
|---|---|---|---|---|
| 6,711,629 | B1 * | 3/2004 | Christensen et al. | 710/8 |
| 6,885,877 | B1 * | 4/2005 | Ozaki et al. | 455/556.1 |
| 7,131,909 | B2 * | 11/2006 | Rowe | 463/42 |
| 7,153,208 | B2 | 12/2006 | Kaminkow et al. | |
| 7,156,737 | B2 * | 1/2007 | Kaminkow et al. | 463/20 |
| 7,403,838 | B2 * | 7/2008 | Deen et al. | 700/276 |
| 7,482,928 | B2 * | 1/2009 | Brackmann et al. | 340/572.1 |
| 7,714,708 | B2 * | 5/2010 | Brackmann et al. | 340/539.1 |
| 2009/0143141 | A1 | 6/2009 | Wells et al. | |

OTHER PUBLICATIONS

"May thy dice chip and shatter" (2009), marketing brochure, at www.GamesByEmail.com and retrieved from Internet on Jun. 26, 2009; author unknown.

"Touch Table Sic Bo," marketing brochure from TCSJohnHuxley.com, Touch Table_Sic_Bo_CIS_01.07_v2.1, retrieved from the Internet at www.tcsjohnbuxley.com/products/ELECTRONICGAMING/TouchTableSicBo/en on Jun. 21, 2010, 3 pgs.

* cited by examiner

SELF-CONTAINED DICE SHAKER SYSTEM

BACKGROUND

1. Technical Field

The present invention relates generally to dice shaker systems and, more particularly, relates to self-contained dice shaker containers that sense and assure the quality of the shake during a shaking event.

2. Description of the Related Art

As the gaming industry has expanded in recent years, so has the proliferation of casino establishment games of chance that require the use of one or more dice. For example, such games include, amongst others, craps, pai gow poker, pai gow (tiles), sic bo, chuck-a-luck, Dice Duel, etc. Although many games that include the use of dice have recently been added, as mentioned, there has always been a need to assure that there is no potential for players or dealers to purposely influence the outcome, and that the outcome of the dice roll is truly random—even in, for example, the bar game of Liar's Dice. When players initiate dice outcomes, for example, casino operators want to ensure that players cannot cheat by influencing the dice outcome. When a dealer initiates dice outcomes, players want to ensure that the dealer does not influence the dice outcome to cause players to unfairly lose. Additionally, casino operators want to ensure that a dealer does not cheat to his or her own advantage (e.g., to benefit a confederate posing as a player). Thus, persons initiating a dice outcome must be able to cause a new outcome but must not be able to influence what the outcome is. In view of this, great lengths are undertaken to assure that each die is substantially symmetrical, and is substantially equally weighted about its center. In some instance, even more extreme measures are applied, such as measuring the amount of paint filling the pips, so as to retain a more balanced die that will not influence the dice roll outcome. Accordingly, improved dice shakers would be desirable.

BRIEF DESCRIPTION OF THE DRAWING

References are made to the accompanying drawings, which form a part of the description and in which are shown, by way of illustration, particular embodiments.

SUMMARY

Figure 1:
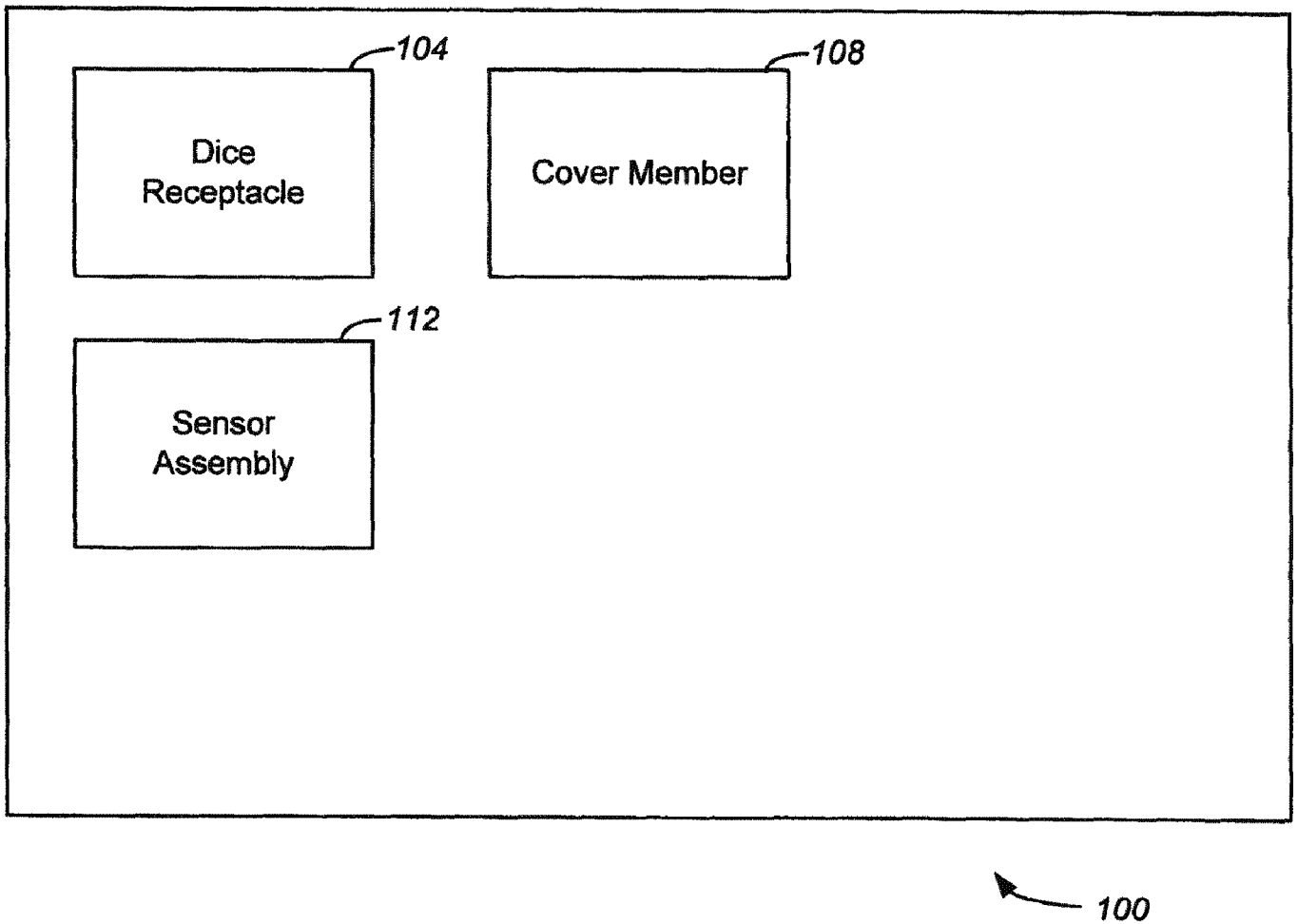
FIG. 1 illustrates a specific example of a dice shaker assembly.

Various embodiments described or referenced herein are directed to different devices, methods, systems, and computer program products for a self-contained dice shaker assembly. According to various embodiments, a self-contained dice shaker assembly may include a container device defining an opening into an interior configured for receipt of one or more dice; and a sensor assembly in communication with the container interior, the sensor assembly configured to monitor, in accordance with one or more predetermined parameters, the shake quality of the dice in the container during a shaking event.

Other embodiments described or referenced herein are related to different devices, methods, systems, and computer program products for a gaming assembly. According to various embodiments, the gaming assembly may include a gaming table; a notification assembly; a remote communication device operably coupled to the notification assembly; and/or a self-contained dice shaker assembly configured for receipt of one or more dice within an enclosed interior thereof, the shaker assembly including an identification assembly operable to identify the outcome of a respective outcome face of each die associated with the outcome of the shaking event, and a communication interface in communication with the remote communication device, wherein the notification assembly is operable to indicate the outcome of each of the one or more dice, as determined by the identification assembly.

In at least one embodiment, a method of operating a self-contained dice shaker assembly may include detecting, using one or more sensors, motion associated with the dice; determining whether the detected motion satisfies one or more predetermined motion parameters; and/or transmitting information related to the detected motion. In some embodiments, the method may include one or more of identifying, using one or more sensors, a value associated with the dice; and transmitting information related to the identified value.

In one or more embodiments, the dice shaker assembly may include any of, or selected ones of, a cover member cooperating with the container device to selectively cover the opening thereof, in a closed condition; a signal assembly configured to signal a user, during the shaking event, whether or not the one or more predetermined parameters have been satisfied, indicating the quality of the shaking event; a cover sensor operable to detect the proper positioning of the cover member over the opening of the container device, in the closed condition; a lock assembly operable to selectively lock the cover member to the container device in a locked condition when the cover member is the closed condition during the shaking event; a monitoring system operably coupled to the sensor assembly, the monitoring system having a processor device and memory, and being operable to monitor whether or not the predetermined parameters have been satisfied during the shaking event; a signal assembly operably coupled to the monitoring system, the signal assembly being operable to signal a user, during the shaking event, whether or not the one or more predetermined parameters have been satisfied, indicating the quality of the shaking event; a communication interface operable to enable communication with a remote communication device; an identification assembly operable to identify the outcome of a respective outcome face of each die associated with the outcome of the shaking event. In one or more embodiments, an identification assembly associated with the dice shaker assembly may include at least one lens device in communication with the interior of the container when the cover member is oriented in the closed condition; and/or an infrared unit operably coupled to the lens device.

DETAILED DESCRIPTION

One or more different inventions may be described in the present application. Further, for one or more of the invention(s) described herein, numerous embodiments may be described in this patent application, and are presented for illustrative purposes only. The described embodiments are not intended to be limiting in any sense. One or more of the invention(s) may be widely applicable to numerous embodiments, as is readily apparent from the disclosure. These embodiments are described in sufficient detail to enable those skilled in the art to practice one or more of the invention(s), and it is to be understood that other embodiments may be utilized and that structural, logical, software, electrical and other changes may be made without departing from the scope of the one or more of the invention(s). Accordingly, those skilled in the art will recognize that the one or more of the invention(s) may be practiced with various modifications and alterations. Particular features of one or more of the invention(s) may be described with reference to one or more particular embodiments or figures that form a part of the present disclosure, and in which are shown, by way of illustration, specific embodiments of one or more of the invention(s). It should be understood, however, that such features are not limited to usage in the one or more particular embodiments or figures with reference to which they are described. The present disclosure is neither a literal description of all embodiments of one or more of the invention(s) nor a listing of features of one or more of the invention(s) that must be present in all embodiments.

Headings of sections provided in this patent application and the title of this patent application are for convenience only, and are not to be taken as limiting the disclosure in any way.

Devices that are described herein as being configured for communication with each other need not be in continuous communication with each other, unless expressly specified otherwise. In addition, devices that are configured for communication with each other may communicate directly or indirectly through one or more intermediaries. A description of an embodiment with several components configured for communication with each other does not imply that all such components are required. To the contrary, a variety of optional components are described to illustrate the wide variety of possible embodiments of one or more of the invention(s).

Further, although process steps, method steps, algorithms or the like may be described in a sequential order, such processes, methods and algorithms may be configured to work in alternate orders. In other words, any sequence or order of steps that may be described in this patent application does not, in and of itself, indicate a requirement that the steps be performed in that order. The steps of described processes may be performed in any order that is practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred.

When a single device or article is described, it will be readily apparent that more than one device/article (whether or not they cooperate) may be used in place of a single device/article. Similarly, where more than one device or article is described (whether or not they cooperate), it will be readily apparent that a single device/article may be used in place of the more than one device or article.

The functionality and/or the features of a device may be alternatively embodied by one or more other devices that are not explicitly described as having such functionality/features. Thus, other embodiments of one or more of the invention(s) need not include the device itself.

Due to the potential for dice substitution and/or to minimize any effects of a throwing technique, gaming establishments typically require the use of a dice cup during a dice roll in certain games. Typically, these two-part dice cups consist of a container portion, defining an opening into a container cavity, and an end cover portion, that cooperates with the container portion to cover an end or the cavity opening thereof. More recent dice shaker designs have improved the mounting security between the end cover and container portion, for example, by adding mating threaded portions that cooperate to threadably secure the cover to the container portion or by adding removable locking features.

While such designs have improved the containment of the dice within the shaking assembly, a skilled person may still be able to influence the outcome of the dice by a controlled shake, or non-shake, of the dice cup. As more advanced gaming systems trend toward dealerless gaming tables, such potential of influencing the outcome is more problematic. Accordingly, there is a need to provide a self-contained dice shaker container that has the ability to provide human-discernable information regarding the correctness and quality of the shake during a shaking event.

Some embodiments of the present invention relate to a self-contained dice shaker assembly including a container device defining an opening into an interior thereof that is configured for receipt of one or more dice. A cover member that cooperates with the container device to selectively cover the opening into the container interior, in a closed condition, may also be provided. A sensor assembly, in communication with the container interior, may be configured to monitor the shake quality of the dice in the container during a shaking event, in accordance with one or more predetermined parameters.

Accordingly, the shake of the self-contained dice shaker may monitored during the shaking event to assess the quality and/or correctness of the shake. For example, a dice shake may be considered "correct" or "valid" (e.g., useable for game play), only if certain criteria and/or parameters are met. Such criteria and/or parameters may include one or more of minimum detected acceleration levels, minimum number of contacts between the dice and one or more surfaces of the dice shaker assembly, and/or other types of detected motion.

In at least one embodiment, the entire dice shaker assembly may be configured to be lifted and manually shaken by a user, thus resulting in a dice shake outcome. Alternately, the dice shaker assembly may be operable to automatically shake the dice using one or more techniques for inducing dice motion, such as vibration. In either case, the dice shaker assembly may include one or more sensors for monitoring the quality of the dice shake (e.g., to ensure a correct and/or valid shake).

In some embodiments, the dice shaker assembly may be operable to determine the outcome of a dice shake. Various techniques may be used to determine the shake outcome. For example, the dice shaker assembly may include one or more sensors operable to ascertain the number of dots on the bottom, top, and/or sides of the dice after a valid shake has occurred.

The dice shaker assembly may be operable to communicate the outcome of a dice shake. For example, the dice shaker assembly may communicate human-discernable information related to the outcome of the dice shake directly to a dealer and/or players through an audible and/or visible indicator. As a different example, the dice shaker assembly may be operable to communicate the outcome of a dice shake to a device, such as a gaming machine.

In some uses, a dealer may operate the dice shaker assembly. For example, the dealer traditionally rolls dice in pai gow poker. Use of the dice shaker assembly in this context may, for example, ensure that the dealer's dice shake is valid and reassure both the casino and players who are participating in the game that the dealer is not cheating (e.g., for the benefit of a confidante). In other uses, a player may operate the dice shaker assembly.

An increasing number of casinos are installing gaming systems that include one or more video displays in a horizontal table-top style play area. These systems, sometimes referred to as eTables, can in some embodiments provide electronic equivalents of playing chips and/or gaming elements such as cards or dice. In some systems, such as the DigiDeal Digital Table System ("DTS")—Hosted Electronic, Multi-Player Table Game system, available from DigiDeal Corp. of Spokane, Wash., a live dealer may oversee an eTable that uses, for example, physical chips for wagering and award payments, but virtual cards for providing the game. Some other systems, such as the DigiDeal DTS-X Non-Hosted Electronic, Multi-Player Table Game system where the gaming chips and the gaming elements (virtual cards for card games, virtual dice for dice games) may only exist in virtual form, may not require direct casino staff attendance or oversight.

Many casinos have replaced at least some gaming tables with eTables, for example to greatly reduce the staffing costs associated with a gaming area. An eTable may require only the general security oversight given to other machine-based game systems instead requiring a dedicated dealer overseen by a managing pit boss overseen by additional security. However, many player are attracted to dice-based games because of their trust in the fairness of physical dice. Typically, the use of physical dice requires significant oversight by casino personnel, which may negate many of the advantages of eTables. It is anticipated that a dice shaker according to some embodiments described herein may allow the use of physical dice in conjunction with eTables or other dealerless or electronic table games without requiring additional supervision by casino personnel.

Certain players are attracted to dice games such as craps which afford players the ability to directly interact with the dice. Similarly, certain players place greater trust in human-driven dice shaking than machine-driven dice shaking. It is anticipated that a dice shaker according to some embodiments described herein could allow human-driven dice shaking while providing improved security and/or requiring less casino staff oversight to assure a certain level of security.

The dice shaker assembly may include one or more security features, such as for example securing the dice against tampering. In some embodiments, a security device may allow adding or removing of dice from the dice shaker assembly only with a physical or electronic key. By preventing tampering with dice, use of the dice shaker assembly in a casino environment may reduce the occurrence of cheating.

Some embodiments of the dice shaker assembly may include a mechanism for preventing unauthorized removal of the dice shaker assembly from a particular location, such as an area near an electronic gaming table or a casino floor. Various types of mechanisms for monitoring the location and/or removal of the dice shaker assembly may be used. For example, the dice shaker assembly may include one or more communication device(s) operable to maintain a communication link with one or more communication device(s) located in a casino. As another example, the dice shaker assembly may include a GPS device for monitoring the location of the dice shaker assembly. If unauthorized removal of the dice shaker assembly is detected, one or more components associated with the dice shaker assembly and/or one or more device(s) located in the casino may be operable to emit an audible and/or silent alarm, notify casino personnel, cease operation, etc. In some embodiments, a dice shaker assembly may be associated with a unique identifier so that it can be tracked in a casino environment.

In some embodiments, use of the dice shaker assembly may allow a greater density of table games (e.g., on a casino floor). For example, use of the dice shaker assembly may allow a table with a large surface for dice rolling to be replaced with a much smaller table, since the dice rolling activity can be performed with the dice shaker assembly.

FIG. 1 depicts a specific example of a dice shaker assembly. Dice shaker assembly 100 includes dice receptacle 104, cover member 108, and sensor assembly 112. According to various embodiments, dice shaker assembly 100 may include one or more additional component(s) not depicted in FIG. 1.

At 104, a dice receptacle is depicted. According to various embodiments, a dice receptacle may be any container, cavity, platform, and/or compartment configured to receive and/or contain one or more dice. For example, dice shaker assembly 100 may include a housing, and dice receptacle 104 may be a compartment and/or cavity associated with the housing. As another example, a dice receptacle may be a platform on which one or more dice may rest. Some such components are described below and are illustrated in FIGS. 2A and 5A-5C.

Dice receptacle 104 is configured such that one or more dice may be contained therein while the dice are shaken. Further, dice receptacle 104 is configured such that after the dice are shaken, the dice come to rest such that the outcome of the dice roll is apparent. For example, dice receptacle 104 may include a substantially flat bottom surface such that after one or more traditional 6-sided dice are shaken, it is usually the case that one and only one side of each of the one or more dice faces up when the dice shaker assembly is placed on a substantially flat surface. In different embodiments, dice receptacle 104 may be configured in different ways to receive and/or contain various types of dice. In at least one embodiment, a dice shaker assembly includes a single dice receptacle. In different embodiments, a dice shaker assembly may include a plurality of dice receptacles, each receptacle configured to receive and/or contain one or more dice.

At 108, a cover member is depicted. In some embodiments, each dice receptacle may be associated with one or more cover members. In different embodiments, a single cover member may be used for more than one dice receptacle. However, a cover member may not necessarily be present in all embodiments. For example, a dice shaker assembly configured for use in chuck-a-luck may not have a cover member separate from the dice receptacle.

According to various embodiments, a cover member may be any surface configured to cover one or more dice receptacles. Thus, according to different embodiments, many different types of cover members may be used. For example, cover member 108 may be opaque, clear, translucent, have varying degrees of light transparency, or some combination thereof. In one embodiment, a cover member may be a clear dome, such as a glass or plastic dome. Alternately, a cover member may be an opaque cup that must be removed to view the dice enclosed in dice receptacle 104. As yet another example, a cover member may be operable to have varying degrees of light transparency or opacity, such as for example being made of smart glass. Examples of such types of materials and/or surfaces include smart glass, light valves, suspended particle devices, liquid crystal devices, electrochromic devices, light-sensitive surfaces, or others that are operable to change in opacity in response to stimulus (e.g., an electronic signal, an electric current, ultraviolet or other type of light, etc.).

In at least one embodiment, the cover member may be fixed to the dice shaker assembly. However, in some embodiments the cover member may be removable so that, for example, dice may be added or removed from dice receptacle 104. Removal of the cover member may be governed by one or more security features. For example, removal of the cover member may require the insertion of a physical key, the transmission of a digital security key, the use of a keypad device on the dice shaker assembly, a biometric authentication technique, etc. Thus, some embodiments of dice shaker assembly 100 may be configured such that a dealer may easily add or remove dice, such as for example in use with games that require different numbers of dice. Alternately, in one or more embodiments a dealer may be unable to easily add or remove dice. In at least one embodiment, a single component may be used to contain one or more dice during shaking rather than a separate receptacle and cover member components. For example, in a dice shaker assembly configured for use with the game of chuck-a-luck, dice may be contained in an hourglass-shaped receptacle that is not associated with a separate cover member component.

In some embodiments the dice may be visible during shaking. However, in at least one embodiment, the dice shaker assembly may be configured to conceal the dice during shaking. Concealing the dice during shaking may, for example, reduce the ability of a user to influence the outcome of a dice shake. Various techniques may be used to conceal the dice. For example, as discussed herein, the dice shaker assembly may include a cover member configured to vary in transparency (e.g., become opaque during shaking). As another example, the dice shaker assembly may include a separator, such as a camera-type iris, scissor shutters, or other type of separator, that visually and physically seals off the shaking compartment from view. As yet another example, one cover member may be used to contain the dice and a separate cover member may be used to conceal the dice. In on such embodiment, the dice may be covered by a clear glass dome. Then, an opaque shield may be fitted over the dome in order to conceal the dice. In a different embodiment, the dice shaker assembly may include a shutter or flap to contain the dice in during shaking and a clear dome outside the shutter or flap through which to see the dice when the shutter or flap is open.

Thus, in some embodiments, the dice may be concealed from view during shaking without shaking the device in a different compartment from the one in which they are displayed. This may, for example, increase player satisfaction with the dice game since the experience for the player may more closely approximate the use of traditional dice shakers.

As discussed herein, in some embodiments the dice shaker assembly is configured to be manually shaken by a user. However, in different embodiments the dice shaker assembly may be configured with a shaking mechanism operable to mechanically and/or automatically shake the dice. Many different types of automatic dice shaking mechanisms may be used. According to various embodiments, a shaking mechanism may include one or more of a manual and/or automatic crank for rotating the dice receptacle, a rod connecting a stepper motor to a driving cam, a vibrating surface associated with the dice receptacle, etc. In some embodiments, shaking may be a combination of manual and automatic activity, such as if a user depresses an actuator which triggers some automatic shaking activity.

At 112, a sensor assembly is depicted. In various embodiments, sensor assembly 112 may include various types, numbers, and combinations of sensors.

In at least one embodiment, the sensor assembly includes one or more sensors operable to determine information related to the quality or outcome of a shake. For example, the sensor assembly may include sensors operable to analyze motion related to a shake, such as for example one or more accelerometers, tilt sensors, tip over sensors, dice floor contact sensors, dice dome contact sensors, inversion sensors, audio sensors, etc. (or some combination thereof). As another example, the sensor assembly may include one or more sensors operable to detect information related to the outcome of a shake, such as one or more optical sensors operable to detect the light reflected by a number of pips on the bottom, sides, and/or top of a die.

The sensor assembly may include one or more cover sensors operable to detect information related to the cover member. For example, the sensor assembly may include a cover sensor operable to determine whether cover member 108 is correctly positioned. As another example, sensor assembly 112 may include one or more lock sensors operable to detect whether the cover member is locked in place. Such cover sensor and lock sensor assemblies may include, for example, one or more electromechanical actuators, magnetic sensors, electrical switches, etc. (or some combination thereof).

In some embodiments, the sensor assembly may include one or more sensors operable to determine whether the dice shaker assembly is resting on a table. For example, the sensor assembly may include one or more of, an optical sensor, a level sensor, eddy current sensor, audio sensor, etc. (or some combination thereof). In at least one embodiment, the dice shaker assembly is configured such that the dice shaker assembly must be placed on a table after a shaking event in order for the shaking event to be valid. For example, a valid shake may require that the dice shaker assembly be placed on a flat surface with a cover member in place or the dice otherwise concealed. As another example, the dice shaker assembly may include with a mechanical shaking device and a valid shake may require that the dice shaker assembly is not removed from the table during and/or after shaking.

Figure 2:
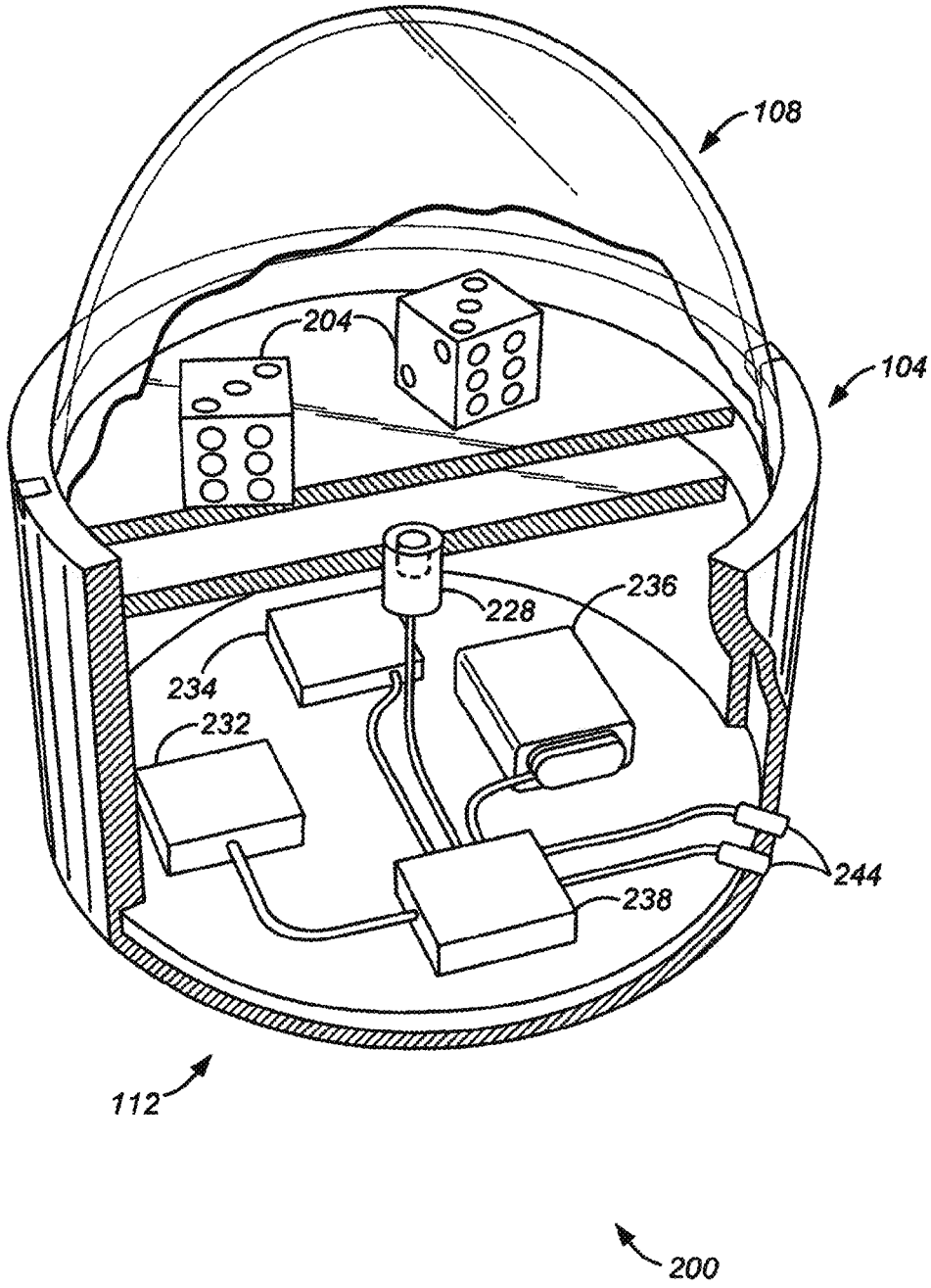
FIG. 2 illustrates a specific example of a dice shaker assembly.

FIG. 2 illustrates a specific example of a dice shaker assembly 200. As illustrated in FIG. 2, dice 204 are contained within a dice receptacle 104 and a cover member 108. As discussed herein, various types of dice, dice receptacles, and cover members may be used. For example, the cover member 108 illustrated in FIG. 2 is a clear glass dome through which the dice are visible.

At 112, an example of a sensor assembly is illustrated. According to various embodiments, various types, numbers, and configurations of components may be used in a sensor assembly. As is illustrated in FIG. 2, one or more electronic components may be located within the dice shaker assembly. For example, the electronic components may include one or more of a power supply, a processor, a memory device, a communication device, a sensor assembly, etc. (or some combination thereof). In the example illustrated in FIG. 2, the components include transmitter/receiver 234, motion unit 232, battery 236, processor 238, and sensor 228, and ports 244. Components such as these will be discussed in greater detail below. It should be noted that the components included in the example dice shaker assembly are only an example configuration of components. In different embodiments, different types, configurations, and/or numbers of components may be used. For example, as will be discussed herein, in some embodiments the dice shaker assembly may include one or more mechanical, rather than electronic, components.

The electronic components present in some embodiments of a dice shaker assembly are powered by one or more power sources, such as a rechargeable battery. Various techniques may be used to provide power to the dice shaker assembly, such as human kinetics (e.g., during shaking), electronic induction, and/or physically coupling the dice shaker assembly to an external power source. As will be described herein, however, in some embodiments the dice shaker assembly may operate without any electric power, such as through the use of mechanical sensors, switches, etc.

In some embodiments, the dice shaker assembly may include a power indicator. A power indicator may provide an indication of how much power is left in a battery associated with the dice shaker assembly or indicate a lower power condition. Various types of power indicators may be used, such as audible alarms, LED displays, LCD displays, etc. Additionally, or alternately, in some embodiments information related to the amount of power remaining in the dice shaker assembly may be transmitted to one or more external devices.

In some embodiments, a dice shaker assembly may also include one or more external ports. According to various embodiments, external ports may be operable to perform various functions. For example, in some embodiments one or more external ports may be operable to couple with an external power source to charge a rechargeable battery in the dice shaker assembly. Alternately, one or more external ports may be operable to communicate with one or more external devices, such as to convey information related to shake quality and/or shake outcome.

Figure 3:
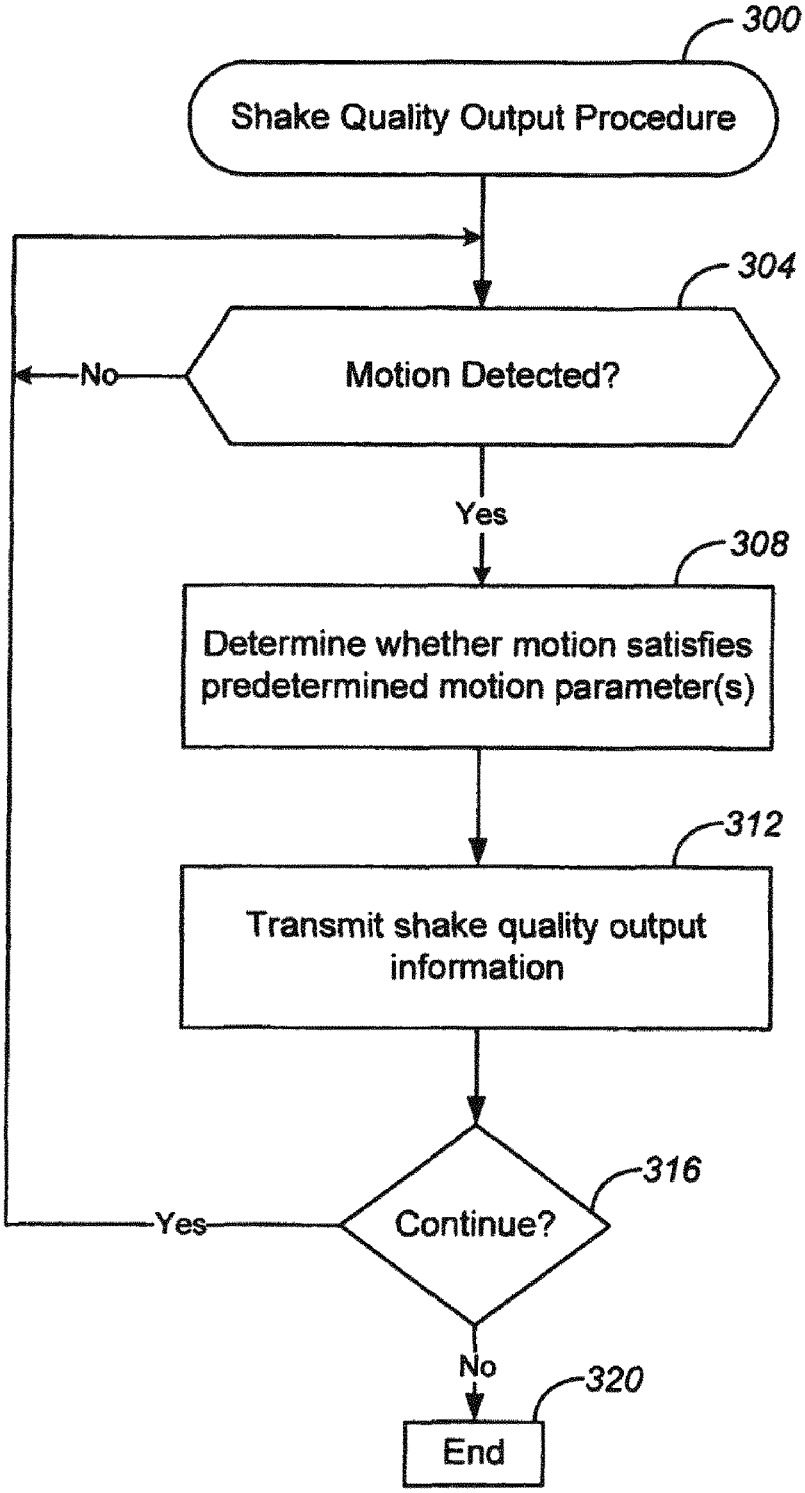
FIG. 3 illustrates a specific example of a shake quality output procedure.

FIG. 3 illustrates a specific example of a Shake Quality Output Procedure 300. A Shake Quality Output Procedure may be used in conjunction with a dice shaker assembly to determine whether dice associated with the dice shaker assembly have been sufficiently shaken. For example, a Shake Quality Output Procedure may be used to determine whether a dice shake satisfies one or more criteria and/or parameters related to the quality of a dice shake. If a dice shake satisfies the criteria and/or parameters, then the dice shake may be considered a valid dice shake for use in one or more games of chance. Determining whether a dice shake is valid may, for example, ensure that the result of the dice shake is substantially random. Thus, a player may be prevented from exercising control over the result of the dice shake by insufficiently shaking the dice.

In some embodiments, each operation associated with Shake Quality Output Procedure 300 may be initiated and/or implemented at a dice shaker assembly. In different embodiments, one or more operations associated with a Shake Quality Output Procedure may be initiated and/or implemented at, for example, a device configured for communication with a dice shaker assembly. In at least one embodiment, a thread or instance of a Shake Quality Output Procedure may be initiated in response to one or more conditions and/or events, such as for example, turning on a dice shaker assembly, detecting motion associated with a dice shaker assembly, termination of a previous thread or instance of a Shake Quality Output Procedure, etc. In some embodiments, a Shake Quality Output Procedure may be used in conjunction with, for example, a Dice Roll Identification Procedure that will be described in reference to FIG. 4.

At 304, motion is detected. As discussed in relation to FIGS. 1 and 2, a dice shaker assembly may include a sensor assembly (e.g., sensor assembly 112). A sensor assembly may include one or more sensors operable to detect motion, such as for example one or more the following (or some combination thereof): accelerometers, tilt sensors, tip over sensors, dice floor contact sensors, dice dome contact sensors, inversion sensors, audio sensors, etc. (or some combination thereof). Thus, the types of motion detected at 304 may include, for example, one or more of the following (or some combination thereof): acceleration, inversion, tilt, tip over, contact between one or more dice and some portion of the dice shaker assembly, etc.

At 308, a determination is made as to whether the detected motion satisfies one or more predetermined criteria and/or parameter(s) related to shake quality. In various embodiments, various types and combinations of shake quality criteria and/or parameters may be used. The following are examples of the types of criteria and/or parameter(s) that may be used to determine whether a shake is correct: (1) The cover member is in place and the dice shaker assembly is inverted at least three times. (2) The cover is locked in place and has at least six changes of direction with sufficient force. (3) The dice shaker assembly is lifted from the table and the dice contact the cover member at least four times. (4) The dice shaker assembly is accelerated by a sufficient force for at least 2 seconds. (5) An automatic shaking device has sufficiently shaken the dice (e.g., an optical disk on a rod connecting a stepper motor to a driving cam of an automatic shaker has rotated a sufficient number of sectors and/or the dice have sufficiently moved from their original position).

In various embodiments, a combination of different criteria and/or types of criteria may be used, such as for example a minimum number of contacts detected and a minimum number of inversions detected. As yet another example, in some embodiments different types of criteria may be combined and then compared to one or more predetermined criteria and/or parameters. For example, a combined value representing both acceleration and tilt information may be compared against a threshold value.

At 312, shake quality output information is transmitted.

According to one or more embodiments, the dice shaker assembly may be configured to transmit human-discernable information related to shake quality. In at least one embodiment, shake quality output information may be transmitted by an audible indicator, such as an audio speaker and/or clacker device. For example, the dice shaker assembly may include one or more speakers operable to emit an audible alarm if a valid shake is detected and/or a different audible alarm if an invalid shake is detected. In some embodiments, shake quality output information may be transmitted by a visible indicator. For example, the dice shaker assembly may include one or more LCD displays, LED displays, seven segment displays, or other types of lights and/or displays that convey information relating to shake quality. As another example, the dice shaker assembly may include a fixed indicator that is hidden and/or revealed by a mechanical trigger, such as a spring, when a valid dice shake is detected.

Many different techniques for signaling human-discernable information regarding the correctness of the shake may be used. The following are examples of such techniques that may be used according to one or more embodiments. (1) Lights and/or sound turn on when a shaking event qualifies or is deemed valid. (2) Lights and/or sound turn on when a shaking event begins and turn off when the shaking even qualifies as a valid shake. (3) An opaque dice cover locks in place until a shake qualifies as a valid shake, at which point it unlock. (4) Warning lights and/or sound occurs when the dice shaker assembly is placed on a flat surface but has not yet met one or more conditions and/or parameters necessary for a valid shake.

According to various embodiments, the dice shaker assembly may be configured to transmit information related to shake quality to another device. For example, the dice shaker assembly may include one or more of a wireless device, infrared device, optical device, or other communication device operable to transmit information related to shake quality. In some embodiments, information related to shake quality may be transmitted over a network and/or directly to a gaming table.

The dice shaker assembly may be configured to transmit shake quality output information only upon detection of a valid shake, only upon detection of an invalid shake, or both. Transmitting an indication that a valid shake was detected may permit the dice shake outcome to be utilized by the player, game table, dealer, etc. Transmitting an indication that an invalid shake was detected may permit a user to recognize that a shake was invalid and try again.

At 316, a determination is made as to whether to continue. According to different embodiments, various criteria may be used to determine whether to continue. For example, in some embodiments the dice shaker assembly may be configured to continue detecting motion and/or monitoring shake quality until an indication to shut down is received. However, in some embodiments a dice shaker assembly may be configured to cease monitoring after transmitting shake quality output information. In such a configuration, the dice shaker assembly may be configured to resume monitoring after receiving an indication to do so. Other examples of criteria that may affect whether to continue at 316 in various embodiments include detection of a predefined number of invalid shakes, a lower power condition, an end of a game and/or gaming session, a determination that the dice shaker assembly has been placed on a surface (e.g., an electronic gaming table), etc.

In some embodiments a Shake Quality Output Procedure may include operations not illustrated in FIG. 3. Additionally, or alternately, one or more operations associated with a Shake Quality Output Procedure may be omitted or performed by a different device. For example, raw data associated with the motion detected may be transmitted directly to a remote communication device which makes the determination as to whether the motion satisfies one or more predetermined motion parameter(s).

Figure 4:
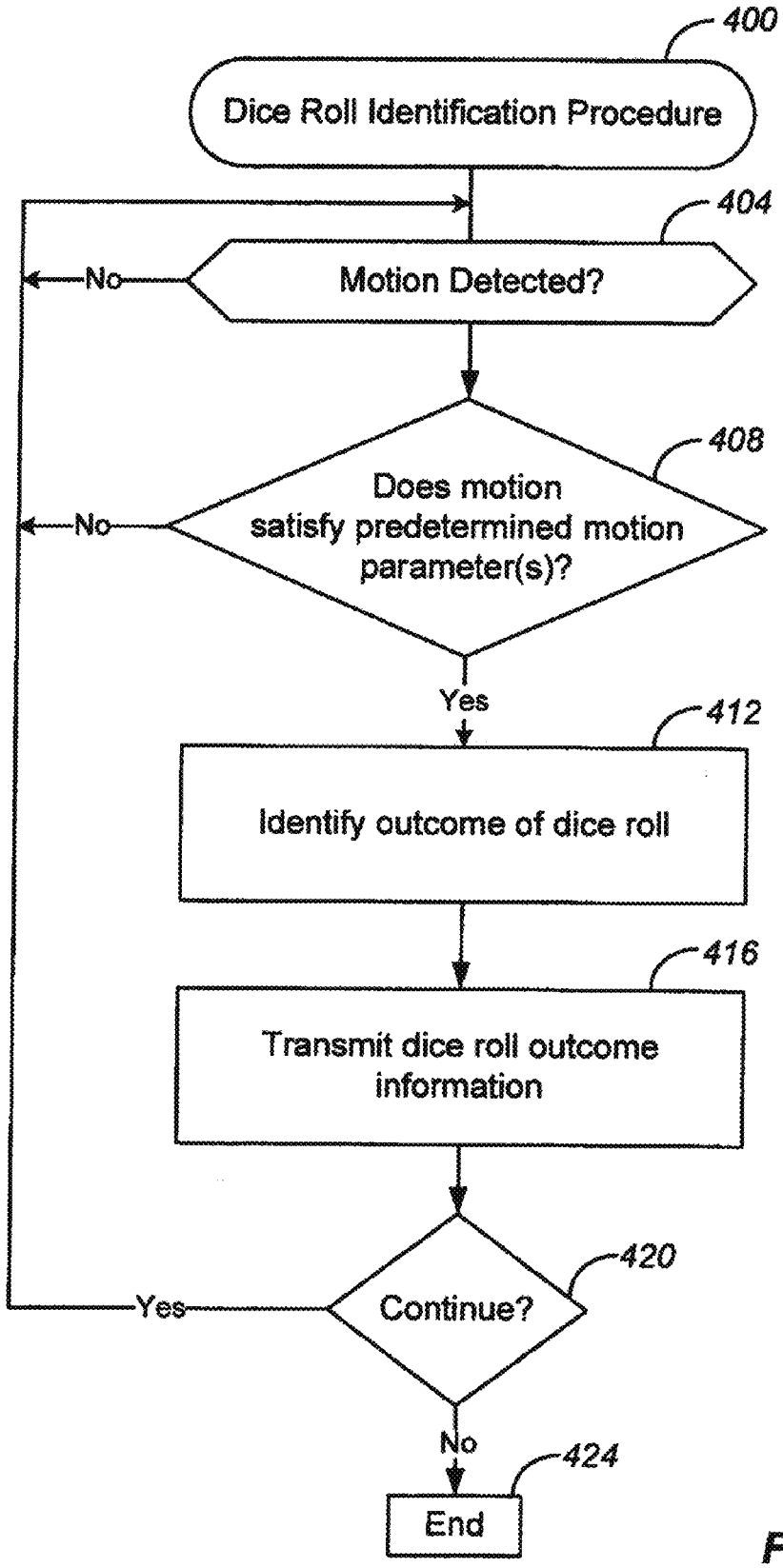
FIG. 4 illustrates a specific example of a dice roll identification procedure.

FIG. 4 illustrates a specific example of a Dice Roll Identification Procedure.

A Dice Roll Identification Procedure may be used in conjunction with a dice shaker assembly to determine the validity and/or outcome of a dice shaking event. For example, a Dice Roll Identification Procedure may be used to determine whether a dice shake satisfies one or more criteria and/or parameters related to the quality of a dice shake. If a dice shake satisfies the criteria and/or parameters, then the dice shake may be considered a valid dice shake for use in one or more games of chance. A Dice Roll Identification Procedure may also be used to determine the outcome of a dice shaking event. For example, one or more sensors may determine the number of pips on each die at rest in the dice receptacle of a dice shaker assembly after a valid shaking event is detected. Determining the validity and/or outcome of a dice shaking event may allow the outcome to be used for gaming purposes, such as in conjunction with a traditional dice game and/or a video gaming machine.

In some embodiments, each operation associated with Dice Roll Identification Procedure 300 may be initiated and/or implemented at a dice shaker assembly. In different embodiments, one or more operations associated with a Dice Roll Identification Procedure may be initiated and/or implemented at, for example, a device configured for communication with a dice shaker assembly. In at least one embodiment, a thread or instance of a Dice Roll Identification Procedure may be initiated in response to one or more conditions and/or events, such as for example, turning on a dice shaker assembly, detecting motion associated with a dice shaker assembly, termination of a previous thread or instance of a Dice Roll Identification Procedure, etc. In some embodiments, a Dice Roll Identification Procedure may be used in conjunction with, for example, a Shake Quality Output Procedure, such as the procedure described in reference to FIG. 3.

At 404, motion is detected. As discussed herein, a dice shaker assembly may include a sensor assembly (e.g., sensor assembly 112). A sensor assembly may include one or more sensors operable to detect motion, such as for example one or more the following (or some combination thereof): accelerometers, tilt sensors, tip over sensors, dice floor contact sensors, dice dome contact sensors, inversion sensors, audio sensors, etc. Thus, the types of motion detected at 404 may include, for example, one or more of the following (or some combination thereof): acceleration, tilt, tip over, inversion, contact between one or more dice and some portion of the dice shaker assembly, etc.

At 408, a determination is made as to whether the detected motion satisfies one or more predetermined criteria and/or parameter(s) related to shake quality. In various embodiments, various types and combinations of shake quality criteria and/or parameters may be used, as discussed for example with respect to operation 308 of FIG. 3.

At 412, the outcome of the dice roll is identified. In some embodiments, as discussed herein, the dice shaker assembly may include one or more sensors operable to identify various kinds of information about dice located in the dice shaker receptacle to determine the outcome of the dice shake. For example, one or more sensors may be used to determine the number of pips on the top, bottom, or sides of one or more dice. Alternately, or additionally, an external device may determine the outcome of a dice shake. For example, the dice shaker assembly may be substantially or partially transparent to one or more types of sensors located in another device, such as the Microsoft Surface®, available from Microsoft, Inc. of Redmond, Wash. The device may then be used to determine information about the dice shake outcome (e.g., when the dice shaker assembly is placed on the device).

According to various embodiments, various types of sensors may be used to determine the dice shake outcome. For example, sensor assembly 112 may include one or more optical sensors operable to detect light reflected by the pips on one or more of the top, bottom, and/or sides of the dice. In at least one embodiment, one or more sensors may be operable to detect visible light, infrared light, ultraviolet light, or some combination thereof.

The incident light may be provided by ambient light sources, or it may be provided by one or more lights included in the dice shaker assembly. For example, dice receptacle 104 illustrated in FIG. 2 may include one or more visible, infrared, and/or ultraviolet light sources designed or configured to illuminate the pips on dice contained in the dice receptacle. In some embodiments, visible, infrared, and/or ultraviolet light may be provided by a light source in a gaming environment external to the dice shaker assembly, such as a light source included in a gaming machine.

Thus, according to various embodiments, different sensors or combinations of sensors may be used in conjunction with different types of dice to determine the dice shake outcome. The following are a few examples of such configurations. (1) One or more sensors may be operable to sense light pips on dark dice, and/or dark pips on light dice. (2) One or more sensors may be operable to sense pips of different colors (e.g., the pips on the "2" side of a 6-sided dice may be green, while the pips on the "3" side of a 6-sided dice may be red.) (3) One or more sensors may be operable to detect ultraviolet and/or infrared color tints, which may be difficult to perceive or invisible to the naked eye, on the pips of one or more dice. (4) Different configurations of pip colors may be used to determine dice outcome. For example, in one embodiment, if a six-sided die has a side with 3 pips, each having a different color or tint, then sensing those colors in combination with the orientation of the pips may be used to infer the value shown on the top of the die.

At 416, dice shake information is transmitted.

According to various embodiments, the dice shaker assembly may be configured to transmit dice shake outcome information to another device. For example, the dice shaker assembly may include one or more of a wireless device, infrared device, optical device, wired device, or other communication device operable to transmit information related to dice shake outcome. In some embodiments, information related to dice shake outcome may be transmitted over a network and/or directly to a gaming table. However, as discussed herein, in some embodiments the dice shaker assembly may be configured such that one or more sensors located in another device can determine the dice shake outcome. In such embodiments, the transmission of information may involve moving the dice shaker assembly into a proper position for the external sensors to read the dice outcome, rather than active communication by the dice shaker assembly.

The dice shaker assembly may be configured to transmit human-discernable information related to the dice shake outcome. For example, shake outcome information may be transmitted by an audible indicator, such as an audio speaker and/or clacker device. As another example, shake outcome information may be transmitted by a visible indicator, such as one or more LCD displays, LED displays, seven segment displays, or other types of lights and/or displays that convey information relating to shake outcome.

According to various embodiments, various types of information related to dice shake outcome may be transmitted. The following are examples of such information. (1) The value of each die may be transmitted. (2) The sum of the die values may be transmitted. (3) Information related to whether or not a player won or lost may be transmitted. For example, LEDs may light up if any player wins. As another example, a player-specific light color may light up for each winning player. As yet another example, celebratory music and/or sound effects may occur if a dealer loses. (4) Other game related information may be transmitted. Such information may include, for example, a craps outcome (e.g., "boxcars," "crapped out," "point made," etc.), dice courage specific outcomes (e.g., the sum of the first two, first three, and all four dice), the dice total and the current game sum for a game of Steamroller, a player color associated with the outcome of a dice shake in a game of pai gow poker, etc.

At 420, a determination is made as to whether to continue. According to different embodiments, various criteria may be used to determine whether to continue. For example, in some embodiments the dice shaker assembly may be configured to continue detecting motion and/or monitoring shake quality until an indication to shut down is received. However, in some embodiments a dice shaker assembly may be configured to cease monitoring after transmitting shake quality output information. In such a configuration, the dice shaker assembly may be configured to resume monitoring after receiving an indication to do so. Other examples of criteria that may affect whether to continue at 316 in various embodiments include detection of a predefined number of invalid shakes, a lower power condition, an end of a game and/or gaming session, a determination that the dice shaker assembly has been placed on a surface (e.g., an electronic gaming table), etc.

According to various embodiments, a Dice Roll Identification Procedure may involve operations not shown in the specific example of FIG. 4. For example, shake quality output information may be transmitted, as is described in relation to operation 312 in FIG. 3. Additionally, or alternately, the operations of the Dice Roll Identification Procedure may be performed in a different order. For example, information received from one or more sensors may be transmitted to a different device, which then performs one or more operations related to determining whether the detected motion satisfies one or more predetermined motion parameter(s) and/or identifying the outcome of the dice shake.

Figure 5A:
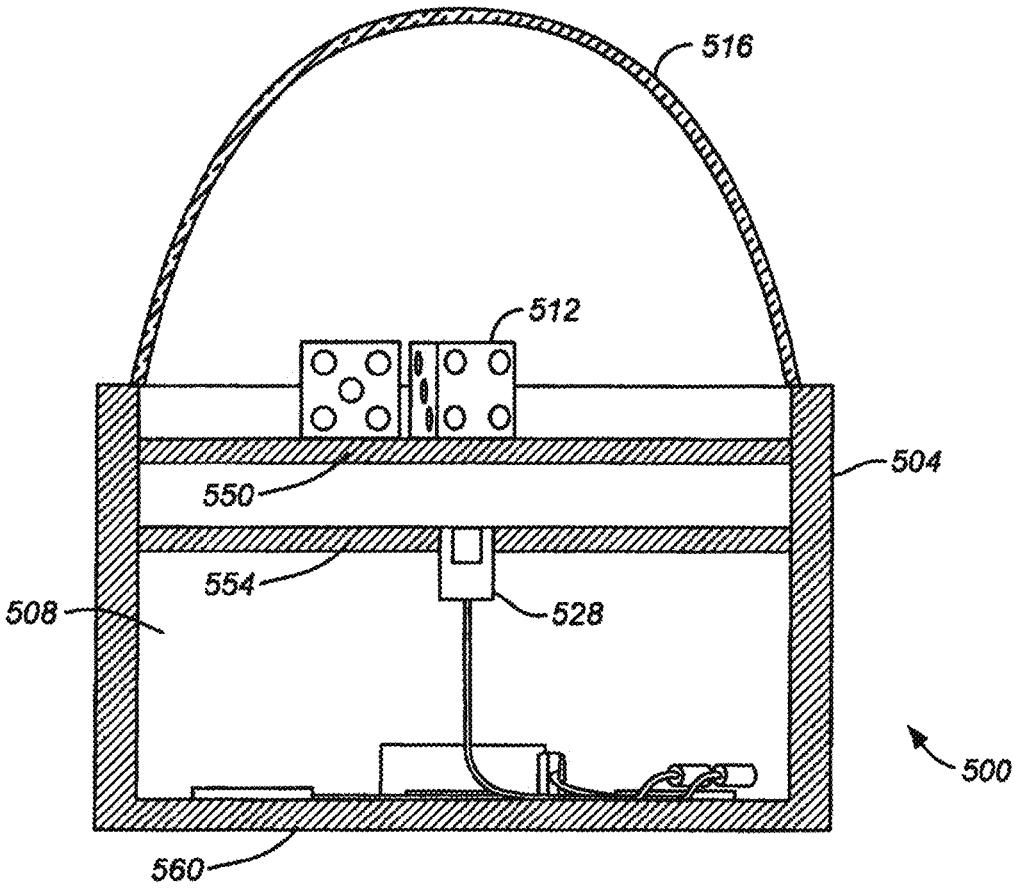
FIG. 5A illustrates a specific example of a dice shaker assembly.

FIG. 5A illustrates a specific example of a dice shaker assembly 500. Dice shaker assembly 500 includes a housing assembly 504, a pair of dice 512, an interior chamber 508, a cover member 516, a sensor 528, a bottom platform 560, an upper layer 550, and a lower layer 554. However, different embodiments of the dice shaker assembly may include components different than those illustrated in dice shaker assembly 500.

At 504, a housing assembly is illustrated. Housing assembly 504 may provide a structural framework for containing other dice shaker components. Further, housing assembly 504 may be configured so as to form a dice receptacle in which one or more dice may be held. Additionally, housing assembly 504 may provide a secure container for preventing tampering with one or more components of the dice shaker assembly. Housing assembly 504 may include one or more features for accessing the interior of the dice shaker assembly. For example, housing assembly 504 may include a door to the interior of the dice shaker assembly. As another example, part of housing assembly 504 may be removable to provide access to the interior of the dice shaker assembly.

At 512, a pair of dice are illustrated. According to various embodiments, various types, sizes, and numbers of dice may be used. For example, two traditional, six-sided dice (204*a*, 204*b*) are illustrated in FIG. 2. However, one or more non-traditional six-sided dice may also be used. Additionally, a dice shaker assembly may include one or more dice having a different number of sides (e.g., 4-sided dice, 8-sided dice, 12-sided dice, 20-sided dice, 2-sided tiles, etc.). As another example, a dice shaker assembly may include dice that are all substantially identical or at least one die that is different or unique from the others. As yet another example, dice of different shapes and/or types may be used concurrently.

At 508, an interior chamber is illustrated. Interior chamber 508 may include and/or enclose various components of the dice shaker assembly. For example, in FIG. 5, interior chamber 508 encloses various electronic components, such as a processor and a sensor assembly. In some embodiments, it is possible to access an interior chamber through one or more openings in the housing 504 or through the dice receptacle.

At 516, a cover member is illustrated. According to various embodiments, a cover member may be any surface configured to cover the dice receptacle. Thus, according to different embodiments, many different types of cover members may be used.

Different cover members may have different optical properties. Cover members may be opaque, clear, translucent, configured with varying degrees of opacity, or some combination thereof. For example, cover member 516 is a clear dome through which the dice 512 are visible. As a different example, a cover member may be configured to have varying degrees of opacity. A cover member that has varying degrees of opacity may include, materials and/or devices configured to change opacity according to stimulus (e.g., electrically switchable glass or glazing which changes light transmission properties when voltage is applied). Thus, in some embodiments the cover member may be configured such that the dice 512 are concealed during shaking and visible after shaking.

At 528, a sensor is illustrated. As discussed herein, different embodiments of the dice shaker assembly dice shaker assembly may include various types, configurations, and numbers of sensors. For example, sensor 528 is an optical sensor operable to determine the outcome of a dice shake. According to various embodiments, sensor 528 may be operable to sense one or more of visible light, infrared light, and/or ultraviolet light. In some embodiments, the dice shaker assembly may also include a light (e.g., a visible light, infrared light, ultraviolet light, multi-spectrum light, etc.) configured to illuminate features of one or more dice.

In some embodiments, the dice shaker assembly may be configured such that dice shake outcome information is visible to one or more sensors without revealing inner chamber to a user. In the example illustrated in FIG. 2, dice 512 rest on upper layer 550, which forms a substantially flat, horizontal disk and is made of a material sufficiently transparent to one or more sensors such that dice outcome information may be sensed. For example, if one or more sensors is operable to sense visible light, then upper layer 550 may be made of glass. As another example, if one or more sensors is operable to sense infrared and/or ultraviolet light, then a material opaque to visible light but transparent to infrared and/or ultraviolet light may be used for upper layer 550. In the example illustrated in FIG. 2, sensor 528 is located in or above lower layer 554. If upper layer 550 is made of a material transparent to visible light, then lower layer 554 may form a substantially horizontal disk and may be made of a material opaque to visible light. If instead upper layer 550 is made of a material opaque to visible light, then lower layer 554 may be made of any material sufficient to support one or more sensors. Further, if upper layer 550 is opaque to visible light, lower layer 554 need not be a horizontal disk, but could be any structure sufficient to support one or more sensors, such as a horizontal bar, an arch, a diagonally supported platform, a horizontal strut, etc.

In some embodiments, a dice shaker assembly may be configured such that a portion of the dice shaker assembly may be opened or removed for servicing. In FIG. 5A, for example, it may be possible to remove the bottom platform 560 to service one or more electronic components contained in the dice shaker assembly.

Figure 5B:
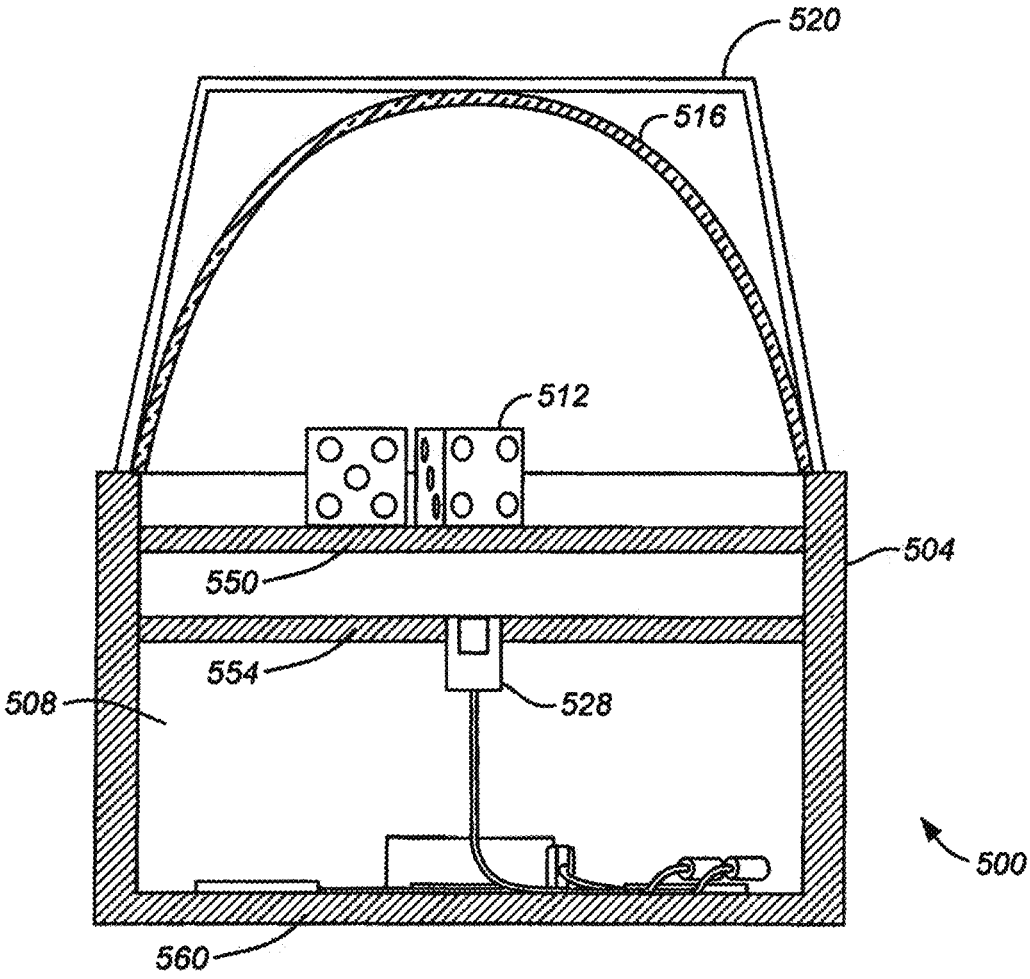
FIG. 5B illustrates a specific example of a dice shaker assembly.

FIG. 5B illustrates a specific example of a dice shaker assembly. Various components illustrated in FIG. 5B may be substantially similar to those illustrated in FIG. 5A.

At 520, a cover member is illustrated. Cover member 520 is an opaque cover operable that may be coupled member dice shaker assembly 500 so that the dice 512 are concealed. For example, cover member 520 may be made of glass, plastic, smart glass, etc. Cover member 520 may be coupled with dice shaker assembly 500 by one or more attachment mechanisms, such as clips, threads, magnets, etc. In some embodiments, one or more cover members may be secured to the dice shaker assembly by a locking device.

According to some uses, cover member 520 must be in place during shaking for a dice shake to be considered valid. For example, a dealer may ensure that the dice are shaken while the cover member is coupled to the dice shaker assembly. As another example, a dice shaker assembly may include a cover sensor operable to determine whether a cover member is correctly and/or securely coupled with the dice shaker assembly. In this way, the dice shaker assembly may be configured to indicate that a shake is valid only if the cover member is in place during shaking. Additionally, a dice shaker assembly may be configured to identify and/or convey a dice shake outcome only if the cover member is in place during shaking.

Figure 5C:
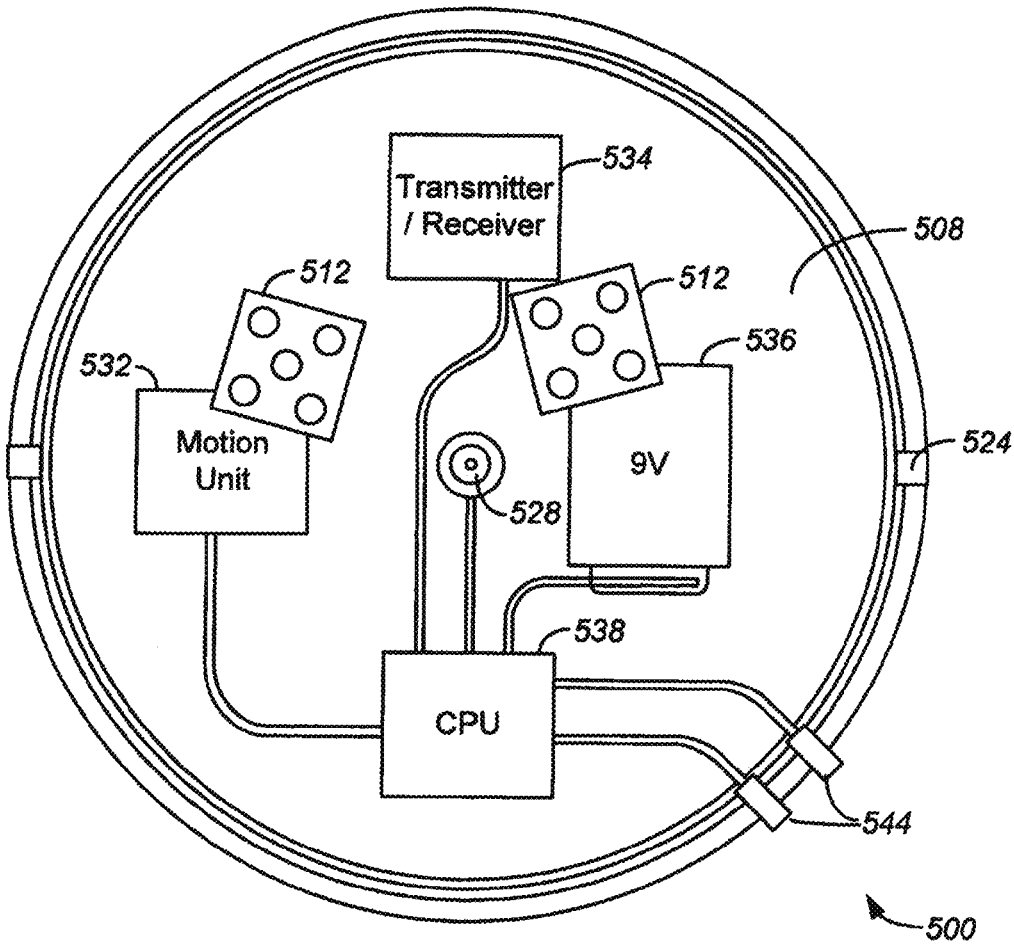
FIG. 5C illustrates a specific example of a dice shaker assembly.

FIG. 5C illustrates a specific example of a dice shaker assembly. Various components illustrated in FIG. 5C may be substantially similar to those illustrated in FIGS. 5A and 5B.

The dice shaker assembly may include one or more processors, such as CPU 538 illustrated in FIG. 5C. According to various embodiments, different types and numbers of processors may be used. The one or more processors in the dice shaker assembly are configured to perform various operations related to the operation of the dice shaker, such as for example one or more operations illustrated in dice roll identification procedure 400 and/or a shake quality output procedure 300. Additionally, CPU 538 may be configured to perform various operations related to power management, sensor use, and/or communication.

At 532, a motion unit is illustrated. According to various embodiments, the motion unit may contain one or more motion sensors. As discussed herein, various types, combinations, and configurations of motion sensors may be used. Additionally, or alternately, the motion unit may be operable to receive information from one or more sensors located elsewhere in the dice shaker assembly. In some embodiments, the motion unit is operable to use received sensor information to determine whether a dice shake is correct and/or valid. The motion unit is operable to then transmit information related to a dice shake outcome, for example to processor 538, transmitter/receiver 534, and/or a different component.

At 524, a cover sensor is illustrated. As discussed herein, the dice shaker assembly may include a cover member. The cover member included in the dice shaker assembly may be detachably coupled to the dice shaker assembly and secured by, for example, threads, clips, magnets, etc. The dice shaker assembly may also include a cover sensor configured to determine whether the cover member is correctly and/or securely positioned. For example, cover sensor 524 may be operable to send a signal to CPU 538 indicating whether the cover member is positioned correctly. As another example, cover sensor 524 may be associated with an audible and/or visual indicator operable to provide an indication that the cover member is positioned correctly.

The dice shaker assembly illustrated in FIG. 5C includes a transmitter/receiver 534 operable to communicate with one or more external devices. According to various embodiments, the transmitter/receiver 534 may include one or more of various types of communication devices operable to transmit and/or receive data. For example, the transmitter/receiver may include one or more Bluetooth devices, unidirectional or bidirectional infrared or optical devices, wireless Ethernet devices, etc. As another example, the transmitter/receiver may include a device operable to read and/or generate optical tags recognized by a vision based system, such as the Microsoft Surface® computing system available from Microsoft, Inc. located in Redwood, Wash.

The transmitter/receiver may be configured to transmit various types of information to an external device. For example, the transmitter/receiver may be configured to transmit the value of each of the dice, the sum of the dice values, whether or not a shake qualified as valid, a power level of the dice shaker assembly, a self-check status signal, etc. Additionally, or alternately, the transmitter/receiver may also be configured to receive various information from an external device. For example, the transmitter/receiver may be configured to receive game state information, game play messaging information, casino marketing messages, etc.

The electronic components of a dice shaker assembly are powered by one or more power sources, such as a rechargeable battery 536. Various techniques may be used to provide power to the dice shaker assembly, such as human kinetics (e.g., during shaking), electronic induction, and/or physically coupling the dice shaker assembly to an external power source. In FIG. 5C, for example, the dice shaker assembly includes external ports 544, which may be coupled with an external power source to provide power to the dice shaker assembly. Additionally, or alternately, the dice shaker assembly may include ports configured to receive and/or transmit communications with external devices.

Figure 6:
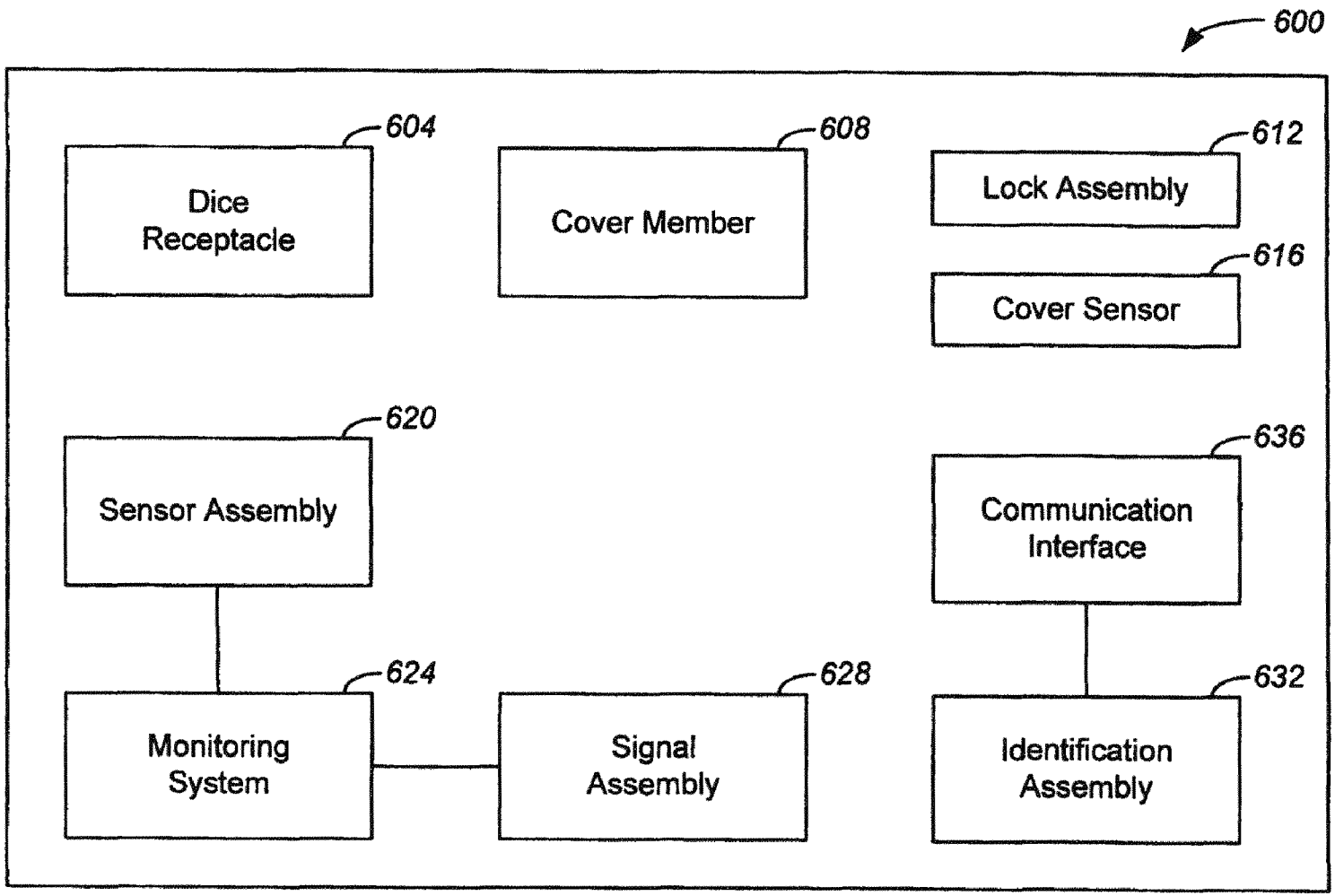
FIG. 6 illustrates a specific example of a dice shaker assembly.

FIG. 6 depicts a specific example of a dice shaker assembly. Dice shaker assembly 600 includes dice receptacle 604, cover member 608, lock assembly 612, and cover sensor 616. Additionally, dice shaker assembly 600 includes sensor assembly 620 coupled with monitoring system 624 and signal assembly 628. Also, dice shaker assembly 600 includes identification assembly 632 coupled with communication interface 636. According to various embodiments, a dice shaker assembly could include additional features not depicted in FIG. 6 and/or include only selected portions of the components shown in FIG. 6.

At 612, a lock assembly is depicted. Lock assembly 612 may be operable to lock cover member 608 in a fixed position to prevent adding and/or removing dice from dice receptacle 604. In some embodiments, lock assembly 612 may be an electromechanical, electromagnetic, mechanical, or other type of lock operable to prevent any unauthorized removal of cover member 108 and/or access to dice receptacle 604. For example, lock assembly 612 may be configured to require one or more of a physical key, an electronic signal, a biometric identification, or other type of authorization indicator to unlock. Thus, in some embodiments access to dice receptacle 604 may be restricted to, for example, selected personnel at a casino. In this way, tampering with the dice stored in dice shaker assembly 604 may be prevented, which may reduce costs in a casino related to cheating and/or monitoring game play.

In different embodiments, lock assembly 612 may include one or more simple threading or catch mechanisms operable to ensure that the dice in dice receptacle 604 do not leave the dice shaker assembly during shaking. This would allow anyone to add or remove dice from the dice receptacle 604. In one or more embodiments, casino personnel could configure a dice shaker assembly with various types of lock assemblies, such as in accordance with different access control policies.

Cover sensor 616 may be configured to sense and/or determine whether cover member 608 is correctly and/or securely coupled with the dice shaker assembly. Cover sensor 616 may include one or more of various types of sensors. For example, cover sensor 616 may include one or more electromechanical actuators that are compressed by a properly positioned cover member. As another example, cover sensor 616 may include one or more electromagnetic cover sensors that detect a proper alignment of the dice shaker assembly with one or more magnetic components on the cover member. As yet another example, cover sensor 616 may include an electrical sensor configured such that a proper positioning of the cover member completes and/or breaks one or more circuits.

In some embodiments, the dice shaker assembly may be configured to indicate that a shake is valid only if the cover member is in place during shaking. Additionally, or alternately, a dice shaker assembly may be configured to identify and/or convey a dice shake outcome only if the cover member is in place during shaking. Thus, cover sensor 616 may assist in ensuring that only valid shaking events are used for generating results used in a game.

Dice shaker assembly 600 includes a sensor assembly 620 that is operable to detect motion related to a shaking event. Thus, sensor assembly 620 may include one or more sensors operable to detect and/or measure information related to shake quality. For example, sensor assembly 620 may include one or more accelerometers, tilt sensors, tip over sensors, dice floor contact sensors, dice dome contact sensors, inversion sensors, audio sensors, etc. (or some combination thereof). For example, one or more sensors may detect the number of times dice shaker assembly 100 is substantially inverted. As another example, sensor assembly 620 may include one or more sensors configured to detect acceleration associated with the dice shaker assembly. As yet another example, the sensor assembly may include one or more sensors operable to detect a number of contacts between the dice in the dice receptacle and one or more other components of the dice shaker assembly.

As discussed herein, the sensor assembly may include one or more inversion sensors, tilt sensors, and/or tip over sensors operable to detect whether the dice shaker assembly has rotated from a substantially vertical position and/or has been shaken so violently that equivalent forces affect the sensor in a similar way. According to various embodiments, sensors may be configured with varying angles of rotation required for a sensor to be affected. For example, the dice shaker assembly may include one or more sensors operable to detect movement from a substantially vertical to a substantially horizontal position, movement from a substantially horizontal to a substantially vertical position, complete inversion, minor variations from a substantially vertical position, etc.

By sensing motion related to a shaking event, sensor assembly 620 may provide the information necessary to determine whether the outcome of a shake is substantially random. In some embodiments sensor assembly 620 may perform other functions, such as turning on the dice shaker assembly from an off state and/or a low power state when motion is detected.

According to various embodiments, the sensor assembly may include various numbers of sensors. For example, the sensor assembly may include one, two, three, or more accelerometers operable to detect acceleration in substantially different directions. In at least one embodiment, the dice shaker assembly includes three accelerometers positioned substantially orthogonal to each other. As another example, the sensor assembly may include sensors of different types, such as one or more accelerometers and one or more tilt sensors, tip over sensors, etc. The use of various numbers of sensors and/or different types of sensors may provide additional evidence that a shaking event was valid and/or substantially random.

In at least one embodiment, the dice shaker assembly may include one or more timer and/or counter devices. A timer device may be used in conjunction with one or more sensors to determine the a length of time associated with a detected motion. For example, a timer device may be used in conjunction with an accelerometer to determine a length of time during which the dice are shaken in excess of a threshold acceleration. A counter device may be used in conjunction with one or more sensors to determine the number of times a detected event has occurred. For example, a counter device may be used in conjunction with one or more contact sensors to count the number of contacts between one or more dice and the floor or cover of the dice shaking compartment.

Sensor assembly 620 is coupled with monitoring system 624. The monitoring system 624 may include one or more processing units, such as CPU 538, as well as other components such as one or more memory devices.

Monitoring system 624 is operable to receive shake quality information from the sensor assembly and determine whether a valid shake has occurred. The monitoring system may be operable to perform, for example, one or more of the operations represented in Shake Quality Output Procedure 300 and/or Dice Roll Identification Procedure 400. For example, the monitoring system may be operable to compare information received from sensor assembly 620 to one or more criteria and/or thresholds. The monitoring system may transmit a determination relating to shake quality to signal assembly 628.

Signal assembly 628 is operable to receive information relating to shake quality from the monitoring system and then transmit shake outcome information.

In at least one embodiment, the signal assembly may include one or more user interface devices to transmit human-discernable information. For example, the signal assembly may include one or more speakers to transmit an audible indication of a valid and/or invalid shake. As another example, the signal assembly may include one or more lights, such as LEDs, that convey information relating to shake quality. In this way, a player and/or dealer may be informed, for example, that a valid dice shake has occurred and that the result may be used for game play. Alternately, or additionally, the signal assembly may convey that a valid dice shake has not occurred and that any outcome currently displayed on the dice may not be used for game play.

In one or more embodiments, the signal assembly may include one or more remote communication devices operable to receive and/or transmit signals relating to shake quality output information. For example, the signal assembly may include one or more devices operable to wirelessly transmit shake quality output information directly to a gaming table. As another example, the signal assembly may include one or more devices operable to communicate over a network. Communicating information related to shake quality to one or more external devices may allow, for example, player usage of the dice shaker assembly to be monitored and/or logged.

At 632, an identification assembly is depicted. Identification assembly 632 is operable to determine the result of a dice shake event. According to various embodiments, the identification assembly may be configured to receive information from sensor assembly 620 and/or may include one or more sensors operable to receive information related to the outcome of a dice shake. Different types and/or numbers of sensors associated with the identification assembly may be located at various locations, according to various embodiments of the dice shaker assembly. For example, the dice shaker assembly may include one or more sensors located below the dice receptacle, as illustrated in FIG. 2. Additionally, or alternately, the dice shaker assembly may include one or more sensors located on the side walls of the dice receptacle, in one or more of cover members, or in a different location in the dice shaker assembly. Further, in some embodiments the dice shaker assembly may include several types of sensors associated with the identification assembly and/or various numbers of sensors at different locations (e.g., for redundancy).

According to various embodiments the sensors associated with the identification assembly may include one or more optical sensors, such as an infrared sensor, operable to sense the number of dots or pips on the top, bottom, and/or sides of one or more dice at rest in dice receptacle 604. In at least one embodiment, sensing the bottom and/or one or more sides of a die at rest may permit the dice shaker assembly to determine by inference the value displayed on the top of the die. For example, the value of the top of a die may be inferred from an orientation of the dots on one or more sides of the dice, a special orientation mark on one or more sides of the dice, etc.

The identification assembly is configured to use the sensor information it receives to determine an outcome of a dice shaking event and transmit that outcome to the communication interface 636. For example, if two traditional six-sided dice are used and the result of a valid dice shaking event is that the top face of each die is a "three," then the identification assembly may be operable to determine that result and transmit it to the communication assembly for communication to a player, dealer, and/or gaming device.

Thus, identification assembly 632 may be coupled with communication interface 636. Communication interface 636 is configured to communicate the shake outcome identified by identification assembly 632.

The communication interface may include, for example, one or more wired and/or wireless devices configured to transmit the shake outcome to a different device in a gaming environment. For example, the communication interface may include a Bluetooth® and/or wifi device. Communication interface 636 may establish a connection with a specific device external to the dice shaker assembly, such as a gaming table. Alternately, the communication interface may transmit and/or broadcast a shake result for receipt by various devices (e.g., in conjunction with a unique identifier associated with the dice shaker assembly). In some embodiments, the communication interface may be configured to connect with one or more devices over a network.

The communication interface may include one or more devices operable to transmit human-discernable information related to the dice shake outcome. For example, shake outcome information may be transmitted by an audible indicator, such as an audio speaker and/or clacker device. As another example, shake outcome information may be transmitted by a visible indicator, such as one or more LCD displays, LED displays, seven segment displays, and/or other types of lights or displays that convey information relating to shake outcome.

Although the components of the dice shaker assembly depicted in FIG. 6 are depicted as separate for purposes of explanation, they are not necessarily physically separate in a dice shaker assembly. For example, a single sensor assembly and/or monitoring system may include and/or be configured to control components such as the lock assembly 612 and the cover sensor 616. As another example, communication interface 636 and signal assembly 628 may be different functions and/or components of a common communication subsystem. As yet another example, one or more CPUs may be configured to receive information from various sensors and/or sensor assemblies in the dice shaker assembly and perform various operations related to dice shake identification, communication, signaling, monitoring, etc.

Figure 7A:
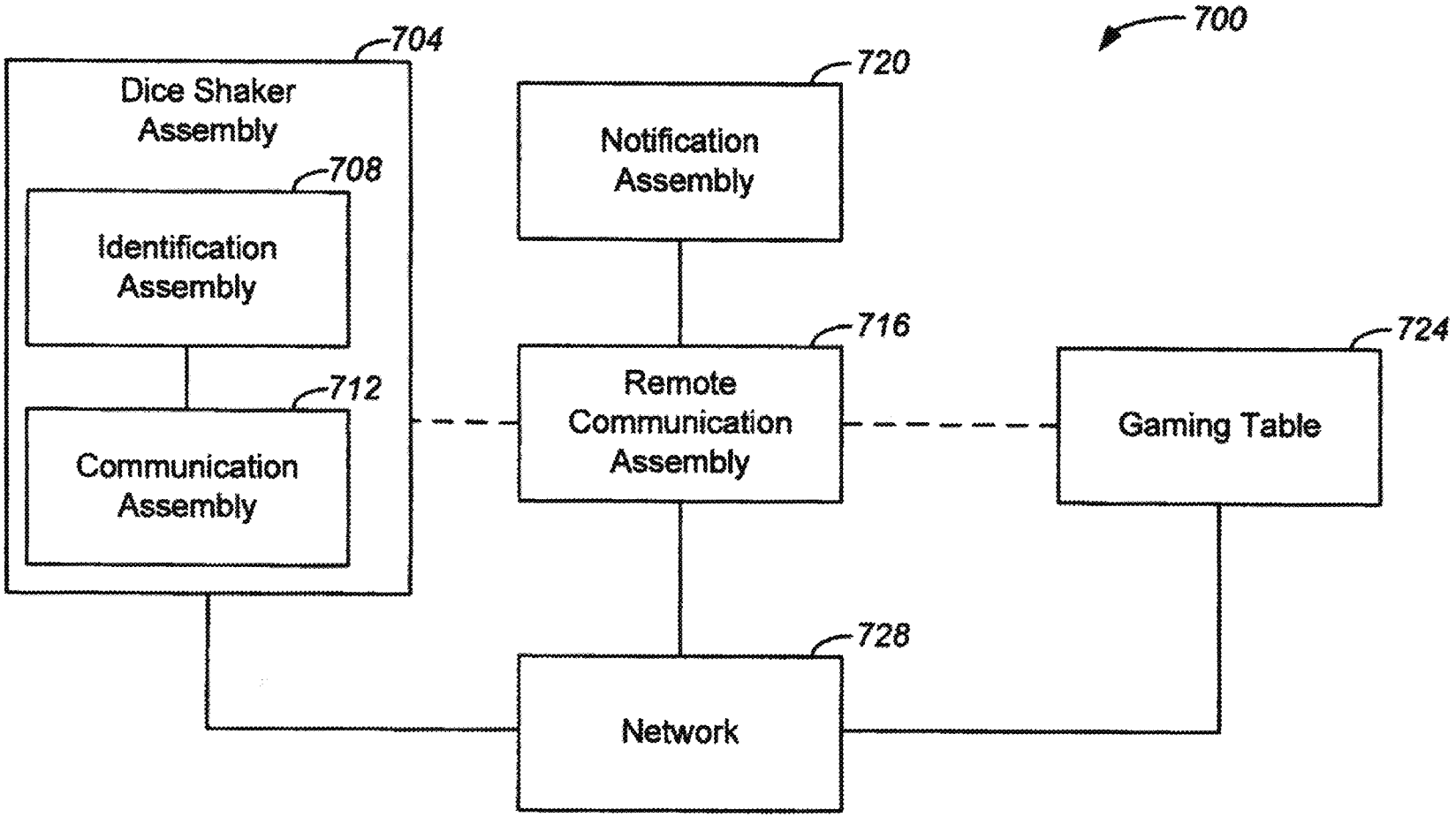
FIG. 7A illustrates a specific example of a gaming environment utilizing a dice shaker assembly.

FIG. 7A depicts a specific example of a gaming environment utilizing a dice shaker assembly. A gaming environment utilizing one or more dice shaker assemblies may include devices and/or components such as one or more gaming tables 724, one or more remote communication assemblies 716, and/or one or more notification assemblies 720. Devices in the gaming environment may communicate directly and/or via one or more networks 728.

At 704, a dice shaker assembly is depicted. As discussed herein, the dice shaker assembly may include components such as identification assembly 708 and communication assembly 712.

In at least one embodiment, the communication assembly is operable to connect to a network, such as network 728. For example, the communication assembly may include a wireless and/or wired Ethernet controller. As another example, the communication assembly may be operable to join a mesh network with other devices, such as by using the Zigbee protocol using a wireless device compliant with the IEEE 802.15.4-200 standard. As yet another example, the communication assembly may be configured to connect to a network via a base station.

The network may be a gaming network in a casino gaming environment. Connecting with a network may allow the dice shaker assembly to interact with many different devices in a gaming environment. The following are examples of such types of interaction. (1) A server may monitor information such as power levels, self-check, location, and/or error conditions for a plurality of dice shaker assemblies. (2) Information sent from a plurality of dice shaker assemblies may be logged on a server for analysis. (3) The dice shaker assembly may receive player messaging and/or advertising information from the network for displaying to a user.

At 720, a notification assembly external to the dice shaker assembly is depicted. The notification assembly, may be operable to display various types of information relating to the validity and/or outcome of a dice shake. Further, as described herein, the notification assembly may use various types of audio and/or visible indicators for notification purposes.

As depicted in FIG. 7A, a notification assembly in some embodiments may be located outside the dice shaker assembly. For example, a video gaming device in a gaming environment may be operable to display various information related to and/or received from the dice shaker assembly. As another example, a separate notification assembly may be positioned somewhere in the gaming environment so that various players may receive information regarding dice shake outcome and/or validity.

The notification assembly is operable to send and/or receive communications with the dice shaker assembly via remote communication assembly 716. The remote communication assembly is operable to send and/or receive various types of information configured for communication with the dice shaker assembly. For example, the remote communication assembly may receive shake quality and/or shake outcome information from the dice shaker assembly. Additionally, the remote communication assembly may be configured to send information to the dice shaker assembly such as game specific information, player messaging, advertising information, etc.

In some embodiments, the remote communication assembly may communicate with the dice shaker assembly over a network. Additionally, or alternately, the remote communication assembly may be in direct communication with the dice shaker assembly. In at least one embodiment, the remote communication assembly is located in a dedicated communication and notification device that can be placed on and/or attached to a gaming machine. However, in some embodiments the remote communication assembly may be part of another device in the gaming environment, such as gaming table 724.

According to various embodiments, various types of gaming tables may be used. For example, the gaming table may be a video gaming table configured to present a dice game to one or more players. The gaming table in some embodiments may be configured with touch screen capabilities. In at least one embodiment, the gaming table is a Microsoft Surface Table. In at least one embodiment, the gaming table is an electronic multiplayer gaming table, available from DigiDeal Corp. of Spokane Valley, Wash. In one or more embodiments, the dice shaker assembly may be embedded in or coupled to another device, such as a gaming table.

Gaming table 724 may be operable to communicate with the dice shaker assembly. According to various embodiments, the gaming table and dice shaker assembly may communicate directly, over a network, or via a remote communication assembly. Communication between the gaming table and the dice shaker assembly may allow, for example, a dice shake outcome to be automatically validated and used in a game of chance (e.g., without dealer interaction). According to various embodiments, such communication may be bilateral, unilateral, continuous, nearly continuous, periodic, intermittent, or some combination thereof.

According to various embodiments, various types of information could be transmitted and/or received via communication between the dice shaker assembly and one or more gaming tables. The communicated information may include, but is not limited to, any of the following (or combinations thereof): dice shake quality information (e.g., a valid and/or correct dice shake, an invalid and/or incorrect dice shake, etc.), dice shake outcome information (e.g., a dice outcome, whether a dice outcome has changed since the last reported dice outcome, etc.), power information (e.g., indication(s) of a power level, indication(s) of a low power condition, indication(s) of a charging battery, etc.), status information (e.g., identification information, time information, indication(s) of proper functioning, indication(s) of error conditions, indication(s) of switching to a lower-power stand-by mode, indication(s) of a successful start up operation, etc.), cover member information (e.g., whether a cover member is on, whether a cover member is off, whether a cover member lock is engaged, whether a cover member was in place during a dice shake, etc.), communication information (e.g., requests for communication, acknowledgement of receipt of communication, etc.), etc.

In some embodiments, the dice shaker assembly may be operable to emit an alarm if the dice shaker assembly is moved too far away from a gaming table, base station, remote communication assembly, or other device in the gaming environment. For example, the dice shaker assembly may be configured with a location device operable to determine and/or transmit a location of the dice shaker assembly. As another example, the dice shaker assembly may be configured to emit an alarm based on the strength of one or more communication connections with other devices in the gaming environment. As yet another example, the dice shaker assembly may include one or more RFID tags, which may allow an alarm to be emitted based on a measure of proximity of the dice shaker assembly to one or more RFID readers. An alarm emitted by the dice shaker assembly may include an audible alarm for notification of casino personnel as well as players and/or a silent signal for electronically notifying casino personnel and/or other devices in the gaming environment. Alternately, or additionally, the gaming table may trigger an audible, visible, and/or electronic communication alarm upon losing contact with the dice shaker assembly.

Figure 7B:
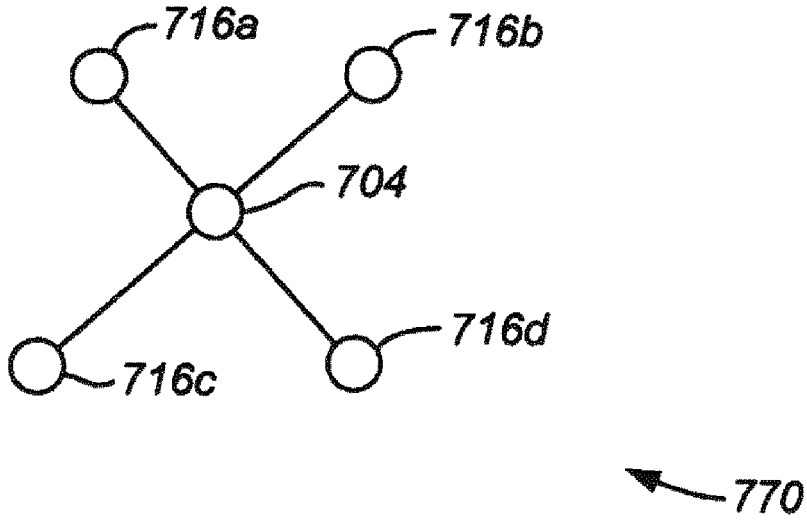
FIG. 7B illustrates a specific example of a gaming environment utilizing a dice shaker assembly.

FIG. 7B depicts a specific example of a gaming environment 770 utilizing a dice shaker assembly. In gaming environment 770, one or more dice shaker assemblies 704 are operable to communicate with a plurality of remote communication assemblies (e.g., 716*a*, 716*b*, 716*c*, 716*d*).

For example, a plurality remote communication assemblies may be associated with a plurality of video gaming machines. In this way, it may be possible for many different players to participate in the same game, such as or sic bo. Additionally, players may be able to participate in a game with live dice rolls without actually being physically near the dice. In one embodiment, for example, players may play traditional dice games while seated at tables, such as in a restaurant.

Figure 7C:
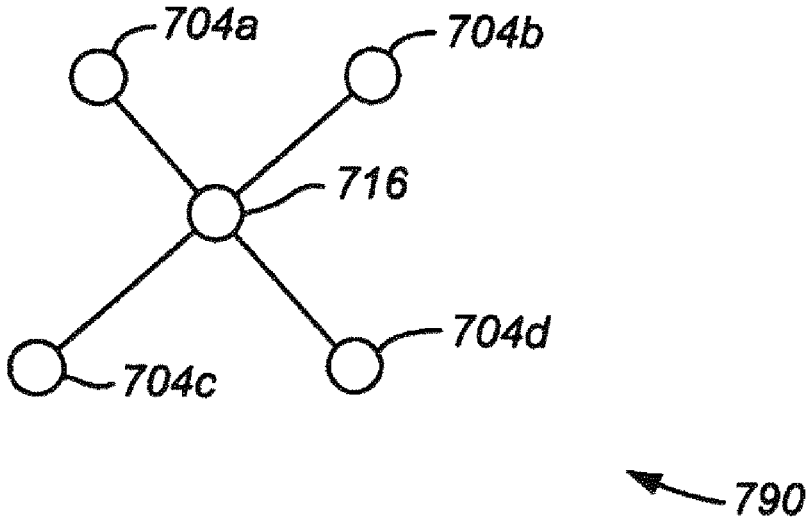
FIG. 7C illustrates a specific example of a gaming environment utilizing a dice shaker assembly.

FIG. 7C depicts a specific example of a gaming environment 790 utilizing a dice shaker assembly. In gaming environment 790, one or more remote communication assemblies 716 are operable to communicate with a plurality of dice shaker assemblies (e.g., 704*a*, 704*b*, 704*c*, 704*d*).

A gaming environment configured in such a way may allow many different players to participate in the same game of chance while each operating a different dice shaker assembly. For example, players seated at a plurality of tables may participate in the same game of chance and each have a dice shaker assembly, taking turns in generating a dice shake outcome used in the game.

Figure 8:
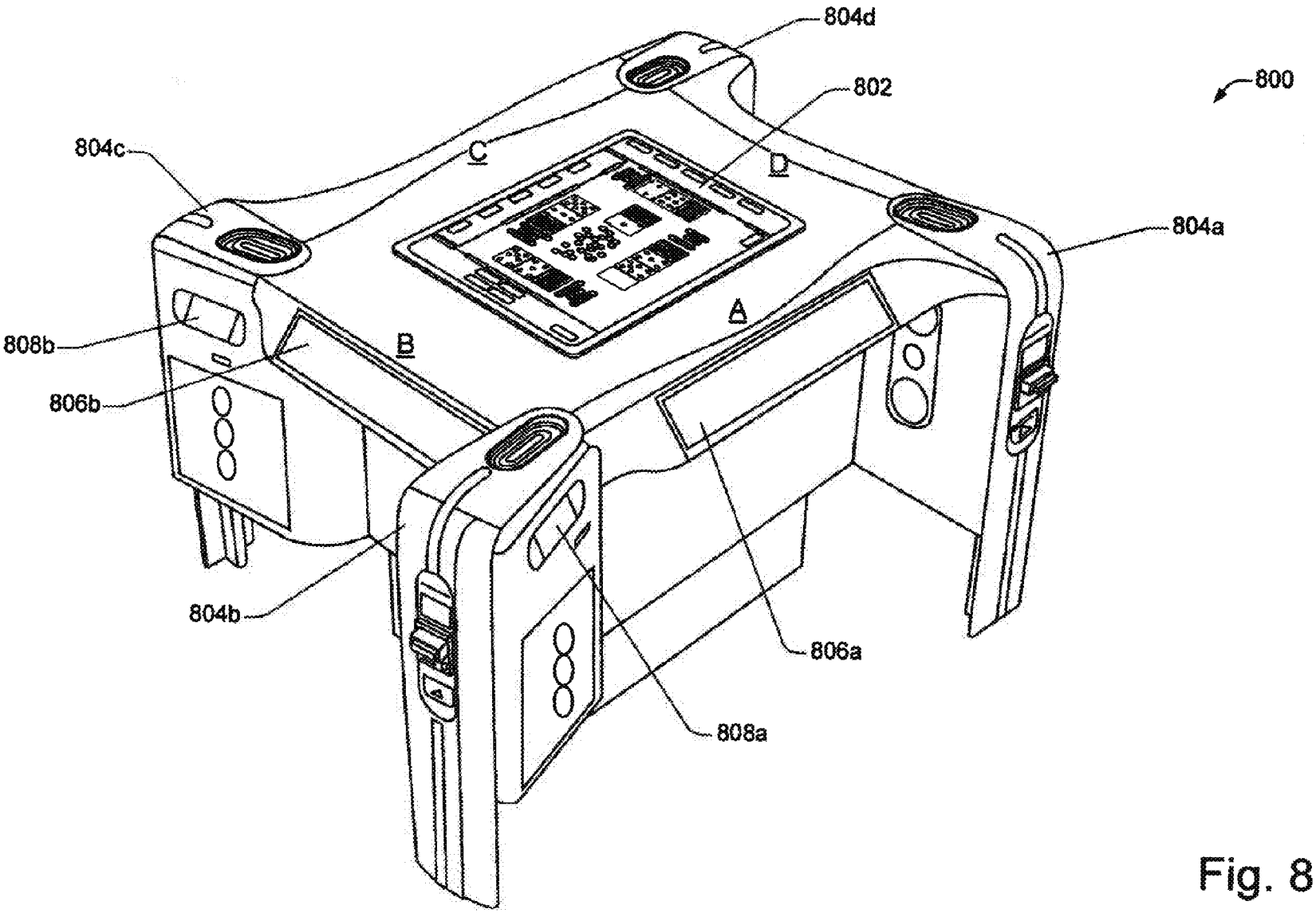
FIG. 8 illustrates a specific example of a gaming table that may be used in conjunction with a dice shaker assembly.

FIG. 8 illustrates a specific example of a gaming table that may be used in conjunction with a dice shaker assembly. As discussed herein, the dice shaker assembly may be used in conjunction with various types of gaming tables. However, the gaming table illustrated in FIG. 8 is an electronic, multi-player gaming table incorporating a Microsoft Surface or other suitable touch-screen display.

Additional details relating to various aspects of gaming table technology are described in U.S. patent application Ser. No. 12/265,627, by Wells, et al., entitled "INTELLIGENT MULTIPLAYER GAMING SYSTEM WITH MULTI-TOUCH DISPLAY", filed Nov. 5, 2008, the entirety of which is incorporated herein by reference for all purposes.

The example of FIG. 5A illustrates an intelligent multi-player electronic gaming system 500 configured as a multi-player electronic table gaming system which includes four player stations (e.g., A, B, C, D), with each player station having a respective funds center system (e.g., 504*a*, 504*b*, 504*c*, 504*d*).

As illustrated in the example of FIG. 5A, electronic table gaming system 500 includes a main display 502 which may be configured or designed as a multi-touch, multi-player interactive display surface having a multipoint or multi-touch input interface. According to different embodiments, various regions of the multitouch, multi-player interactive display surface may be allocated for different uses which, for example, may influence the content which is displayed in each of those regions. For example, the multi-touch, multi-player interactive display surface may include one or more designated multi-player shared access regions, one or more designated personal player regions, one or more designated dealer or house regions, and or other types of regions of the multi-touch, multi-player interactive display surface which may be allocated for different uses by different persons interacting with the multi-touch, multi-player interactive display surface. As another example, the multi-player interactive display surface may be used to display information associated with the dice shaker assembly, such as for example dice shake quality and/or dice shake outcome information.

Additionally, as illustrated in the example of FIG. 5A, each player station may include an auxiliary display (e.g., 506*a*, 506*b*) which, for example, may be located or positioned below the gaming table surface. In this way, content displayed on a given auxiliary display (e.g., 506*a*) associated with a specific player/player station (e.g., Player Station A), may not readily be observed by the other players at the electronic table gaming system. According to various embodiments, one or more of the auxiliary displays may be used to display information associated with the dice shaker assembly, such as for example dice shake quality and/or dice shake outcome information.

In at least one embodiment, each auxiliary display at a given player station may be provided for use by the player occupying that player station. In at least one embodiment, an auxiliary display (e.g., 506*a*) may be used to display various types of content and/or information to the player occupying that player station (e.g., Player Station A). For example, in some embodiments, auxiliary display 506*a* may be used to display (e.g., to the player occupying Player Station A) private information, confidential information, sensitive information, and/or any other type of content or information which the player may deem desirable or appropriate to be displayed at the auxiliary display. Additionally, in at least some embodiments, as illustrated in the example of FIG. 5A, each player station may include a secondary auxiliary 30 display (e.g., 508*a*, 508*b*).

In some embodiments, use of the dice shaker assembly in conjunction with gaming table 800 may permit the casino to offer a dice game without the presence of a dealer. However, the dice shaker assembly may be used in conjunction with the gaming table even if a dealer is present.

Use the dice shaker assembly in conjunction with gaming table 800 may also permit various types of communication using sensing and/or communication capabilities of the gaming table. For example, in some embodiments, the dice shaker assembly may include a device operable to generate and/or read optical tags recognized by a vision based system included in the gaming table. Types of optical tags that may be used for transmission of information could include one or more one-dimensional barcodes, two-dimensional barcodes, matrix codes, symbols, glyphs, or any other code for encoding data. In some embodiments, the dice shaker assembly can generate the appropriate image using one or more electronic displays, such as LEDs, LCDs, smart paper displays, etc. Alternately, or additionally, the dice shaker assembly may use one or more electromechanical shutters, smart glass panes, etc. to reveal all or selected portions of encoded data present in or on the dice shaker assembly.

Additionally, in some embodiments, gaming table 800 may perform one or more functions described herein as being performed by the dice shaker assembly. For example, an electronic gaming table may be operable to determine whether the dice shaker assembly is removed from the table and/or when the dice shaker assembly is placed on the table. In some embodiments, such information may be communicated back to the dice shaker assembly from the gaming table. Thus, in some embodiments, the dice shaker assembly may be able to perform one or more actions (e.g., activating one or more audible and/or visible indicators, transmitting information regarding shake quality and/or shake outcome, etc.) in accordance with information determined at an external device, such as a gaming table.

In some embodiments, the dice shaker assembly may be designed and/or configured such that external sensors could determine the dice outcome. For example, in one embodiment the bottom of the dice shaker assembly is transparent to infrared light. The dice shaker assembly may include dice with "white" portions that reflect infrared light (e.g., white dice with dark dots, and/or dark dice with white dots). In this way, the pattern of dots on the dice may be illuminated to one or more infrared sensors. When the dice shaker assembly is placed on the surface of a surface table having infrared sensors, the infrared sensors can be used to determine the outcome of the dice shake. Benefits of such embodiments may include, for example, a lower production cost of the dice shaker assembly, decreased power consumption by the dice shaker assembly, and/or greater security against tampering.

In at least one embodiment, use of the dice shaker assembly in conjunction with a gaming table may permit the operation of a dice shaker assembly without any power source or with reduced power needs. For example, the dice shaker assembly may be designed and/or configured with a mechanical shake sensor and/or vibration sensor. Further, the dice shaker assembly may be configured such that one or more sensors associated with the gaming table (e.g., infrared cameras) can verify the correctness of the dice shake and/or ascertain the dice outcome without the presence of electric components on the dice shaker assembly.

For example, a mechanical shake and/or vibration sensor associated with the dice shaker assembly may combined a timed value with an angle of force. The shake sensor may be reset by a push button, a lever, or some other mechanism. When the mechanical shake sensor is triggered, it may trip a mechanical notification device. For example, triggering the mechanical shake sensor may flip an infrared reflector into a transparent window located in an area of the dice shaker assembly for reading by an external device. Thus, the gaming table could sense the external device while reading the dice outcome and could, for example, ignore any dice shake outcome where the infrared reflector is not visible.

It is anticipated that in such an embodiment, a player might seek to manipulate the dice outcome after triggering the mechanical shake sensor. Thus, some embodiments may be equipped with a mechanical device, such as a shutter or iris, for concealing the dice when the dice shaker assembly is shaken and resetting when the mechanical shake sensor is reset.

Because information and program instructions may be employed to implement the systems and methods described herein, various aspects are directed to machine-readable storage media that include program instructions, state information, etc. for performing various operations described herein. Examples of machine-readable storage media include, but are not limited to, magnetic media such as, for example, hard disks, floppy disks, and magnetic tape; optical media such as, for example, CD-ROM disks; magneto-optical media such as, for example, floptical disks; and hardware devices that are specially configured to store and perform program instructions, such as, for example, read-only memory devices (ROM) and random access memory (RAM). Examples of program instructions include both machine code, such as, for example, produced by a compiler, and files containing higher level code that may be executed by the computer using an interpreter.

Although illustrative embodiments and applications of the various embodiments described herein are shown and described herein, many variations and modifications are possible which remain within the concept, scope, and spirit of the disclosed embodiments, and these variations would become clear to those of ordinary skill in the art after perusal of this application. Moreover, in at least some embodiments, various procedural operations such as those described herein may be implemented in alternative order and/or may be omitted. Accordingly, the examples described herein are to be considered as illustrative and not restrictive, and the various embodiments are not to be limited to the details given herein, but may be modified within the scope and equivalents of the appended claims.

What is claimed is:

1. A gaming assembly comprising:

a gaming table;

a notification assembly;

a remote communication device operably coupled to the notification assembly; and a self-contained dice shaker assembly configured for receipt of one or more dice within an enclosed interior thereof, the shaker assembly including:

(a) a container device defining an opening into the interior, (b) a cover member cooperating with the container device to selectively cover the opening thereof, in a closed condition, (c) a cover sensor operable to detect the proper positioning of the cover member over the opening of the container device, in the closed condition, (d) an identification assembly operable to identify the outcome of a respective outcome face of each die associated with the outcome of the shaking event, (e) a communication interface in communication with the remote communication device, wherein the notification assembly is operable to indicate the outcome of each of the one or more dice, as determined by the identification assembly, (f) a sensor assembly in communication with the interior and configured to monitor the shake quality of the dice in the container during a shaking event, in accordance with one or more predetermined parameters, and (g) a signal assembly configured to signal a user, during the shaking event, whether the one or more predetermined parameters have been satisfied, indicating the quality of the shaking event.

2. The gaming assembly according to claim 1, wherein the cover sensor includes one or more micro-switch devices positioned between and in contact with the cover member and the container device, proximate the opening into the container interior thereof.

3. The gaming assembly according to claim 1, wherein the dice shaker assembly further includes a lock assembly operable to selectively lock the cover member to the container device in a locked condition when the cover member is the closed condition during the shaking event.

4. The gaming assembly according to claim 1, wherein the dice shaker assembly further includes a monitoring system operably coupled to the sensor assembly, the monitoring system having a processor device and memory, and being operable to monitor whether or not the predetermined parameters have been satisfied during the shaking event.

5. The gaming assembly according to claim 4, wherein:

the signal assembly is operably coupled to the monitoring system.

6. The gaming assembly according to claim 1, wherein the identification assembly include at least one lens device in communication with the interior of the container when the cover member is oriented in the closed condition.

7. The gaming assembly according to claim 6, wherein the identification assembly includes an infrared unit operably coupled to the lens device.

8. A gaming assembly comprising:
a gaming table;
a notification assembly;
a remote communication device operably coupled to the notification assembly; and
a self-contained dice shaker assembly configured for receipt of one or more dice within an enclosed interior thereof, the shaker assembly including:
(a) a sensor assembly in communication with the interior, and configured to monitor the shake quality of the dice in the container during a shaking event, in accordance with one or more predetermined parameters,
(b) an identification assembly operable to identify the outcome of a respective outcome face of each die associated with the outcome of the shaking event,
(c) a communication interface in communication with the remote communication device, wherein the notification assembly is operable to indicate the outcome of each of the one or more dice, as determined by the identification assembly, and
(d) a monitoring system operably coupled to the sensor assembly, the monitoring system having a processor device and memory, and being operable to monitor whether the predetermined parameters have been satisfied during the shaking event.

9. The gaming assembly according to claim 8, wherein the dice shaker assembly further includes:
(d) a container device defining an opening into the interior, and a cover member cooperating with the container device to selectively cover the opening thereof, in a closed condition, and
(e) a cover sensor operable to detect the proper positioning of the cover member over the opening of the container device, in the closed condition, wherein the cover sensor includes one or more micro-switch devices positioned between and in contact with the cover member and the container device, proximate the opening into the container interior thereof.

10. The gaming assembly according to claim 8, wherein the dice shaker assembly further includes:
(d) a container device defining an opening into the interior, and a cover member cooperating with the container device to selectively cover the opening thereof, in a closed condition,
(e) a cover sensor operable to detect the proper positioning of the cover member over the opening of the container device, in the closed condition, and
(f) a lock assembly operable to selectively lock the cover member to the container device in a locked condition when the cover member is the closed condition during the shaking event.

11. The gaming assembly according to claim 8, wherein the dice shaker assembly further includes a signal assembly configured to signal a user, during the shaking event, whether or not the one or more predetermined parameters have been satisfied, indicating the quality of the shaking event.

12. The gaming assembly according to claim 8, further including:
a signal assembly operably coupled with the monitoring system, the signal assembly being operable to signal a user, during the shaking event, whether or not the one or more predetermined parameters have been satisfied, indicating the quality of the shaking event.

13. The gaming assembly according to claim 8, wherein the identification assembly includes at least one lens device in communication with the interior of the container when the cover member is oriented in the closed condition.

14. The gaming assembly according to claim 13, wherein the identification assembly includes an infrared unit operably coupled to the lens device.

15. A gaming assembly comprising:
a gaming table;
a notification assembly;
a remote communication device operably coupled to the notification assembly; and
a self-contained dice shaker assembly configured for receipt of one or more dice within an enclosed interior thereof, the shaker assembly including:
(a) a container device defining an opening into the interior, and a cover member cooperating with the container device to selectively cover the opening thereof, in a closed condition,
(b) an identification assembly operable to identify the outcome of a respective outcome face of each die associated with the outcome of the shaking event, wherein the identification assembly includes at least one lens device in communication with the interior of the container when the cover member is oriented in the closed condition and an infrared unit operably coupled to the lens device,
(c) a communication interface in communication with the remote communication device, wherein the notification assembly is operable to indicate the outcome of each of the one or more dice, as determined by the identification assembly, and
(d) a sensor assembly in communication with the interior and configured to monitor the shake quality of the dice in the container during a shaking event, in accordance with one or more predetermined parameters.

16. The gaming assembly according to claim 15, wherein the dice shaker assembly further includes:
(d) a container device defining an opening into the interior, and a cover member cooperating with the container device to selectively cover the opening thereof, in a closed condition, and
(e) a cover sensor operable to detect the proper positioning of the cover member over the opening of the container device, in the closed condition, wherein the cover sensor includes one or more micro-switch devices positioned between and in contact with the cover member and the container device, proximate the opening into the container interior thereof.

17. The gaming assembly according to claim 15, wherein the dice shaker assembly further includes:
(d) a container device defining an opening into the interior, and a cover member cooperating with the container device to selectively cover the opening thereof, in a closed condition,
(e) a cover sensor operable to detect the proper positioning of the cover member over the opening of the container device, in the closed condition, and
(f) a lock assembly operable to selectively lock the cover member to the container device in a locked condition when the cover member is the closed condition during the shaking event.

18. The gaming assembly according to claim 15, wherein the dice shaker assembly further includes a signal assembly configured to signal a user, during the shaking event, whether or not the one or more predetermined parameters have been satisfied, indicating the quality of the shaking event.

19. The gaming assembly according to claim 15, wherein the dice shaker assembly further includes a monitoring system operably coupled with the sensor assembly, the monitoring system having a processor device and memory, and being operable to monitor whether or not the predetermined parameters have been satisfied during the shaking event.

20. The gaming assembly according to claim 19, further including:

a signal assembly operably coupled to the monitoring system, the signal assembly being operable to signal a user, during the shaking event, whether or not the one or more predetermined parameters have been satisfied, indicating the quality of the shaking event.

* * * * *